US008677797B2

(12) United States Patent
Yamawaki et al.

(10) Patent No.: US 8,677,797 B2
(45) Date of Patent: Mar. 25, 2014

(54) HOLLOW RACK MANUFACTURING METHOD AND MANUFACTURING APPARATUS

(75) Inventors: Takashi Yamawaki, Komaki (JP); Takuya Nakamizo, Tajimi (JP)

(73) Assignee: Neturen Co., Ltd., Tokyo (JP)

( * ) Notice: Subject to any disclaimer, the term of this patent is extended or adjusted under 35 U.S.C. 154(b) by 831 days.

(21) Appl. No.: 12/051,964

(22) Filed: Mar. 20, 2008

(65) Prior Publication Data

US 2008/0229803 A1 Sep. 25, 2008

(30) Foreign Application Priority Data

Mar. 20, 2007 (JP) ..... 2007-073622
Mar. 20, 2007 (JP) ..... 2007-073623
Mar. 20, 2007 (JP) ..... 2007-073624

(51) Int. Cl.
*B21D 17/02* (2006.01)
*B21J 13/00* (2006.01)

(52) U.S. Cl.
USPC ..... 72/370.01; 72/355.6

(58) Field of Classification Search
USPC ..... 72/353.2, 353.6, 354.2, 354.6, 72/355.2–355.6, 356–360, 370.01; 29/893.34, 897.2
See application file for complete search history.

(56) References Cited

U.S. PATENT DOCUMENTS

| | | | |
|---|---|---|---|
| 6,289,710 | B1 | 9/2001 | Ozeki |
| 6,494,073 | B2 | 12/2002 | Oka |
| 6,575,009 | B2 | 6/2003 | Shiokawa |
| 2006/0016238 | A1 | 1/2006 | Shiokawa |

FOREIGN PATENT DOCUMENTS

| | | | |
|---|---|---|---|
| EP | 1020243 | A | 7/2000 |
| EP | 1112791 | A | 7/2001 |
| EP | 1769859 | A | 4/2007 |
| JP | 51-126324 | | 10/1976 |
| JP | 54112777 | A | 9/1979 |
| JP | 55-88303 | | 6/1980 |
| JP | 3-5892 | | 1/1991 |
| JP | 4-167944 | | 6/1992 |
| JP | 6-28772 | | 4/1994 |
| JP | 2002-86243 | | 3/2002 |
| JP | 2002066685 | A | 3/2002 |
| JP | 2002086243 | A | 3/2002 |
| JP | 2003-53404 | | 2/2003 |
| JP | 2004523365 | A | 8/2004 |
| JP | 3607204 | B2 | 1/2005 |
| JP | 2006-26703 | | 2/2006 |
| JP | 2006103644 | A | 4/2006 |

OTHER PUBLICATIONS

European Search Report for related European Application No. 10003814.0 (Jul. 7, 2010).

*Primary Examiner* — Teresa M Ekiert
(74) *Attorney, Agent, or Firm* — Baker & Hostetler LLP

(57) ABSTRACT

With a first push rod which is to be inserted/removed into/from a steel pipe through an opening at one end and a second push rod which is to be inserted/removed into/from the steel pipe through an opening at the other end, a metal core disposed on a side on which the first push rod is inserted/removed into/from the die assembly is sandwiched and this metal core is stopped from rotating with the first push rod. With the state of stopping the rotation of the first push rod, the metal core is introduced into the steel pipe through the opening at the one end by both the push rods. After the metal core is pressed into the steel pipe while stopped from rotating with the first push rod, this metal core is pushed back by the second push rod.

16 Claims, 15 Drawing Sheets

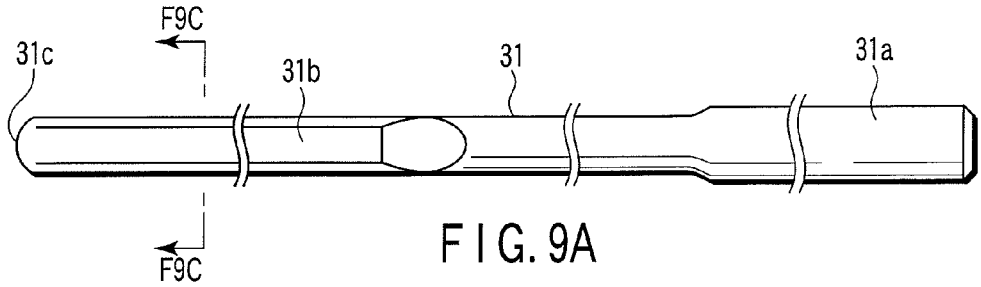
FIG. 9A
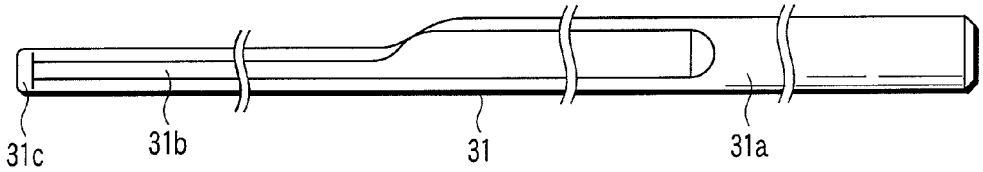
FIG. 9B
FIG. 9C
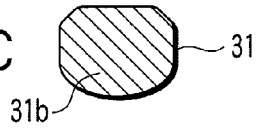
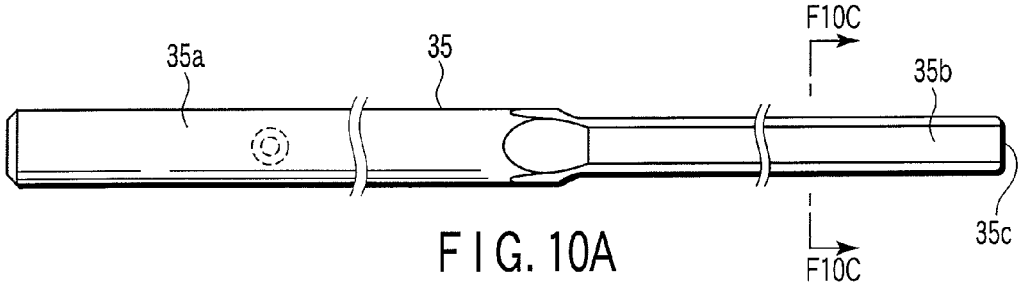
FIG. 10A
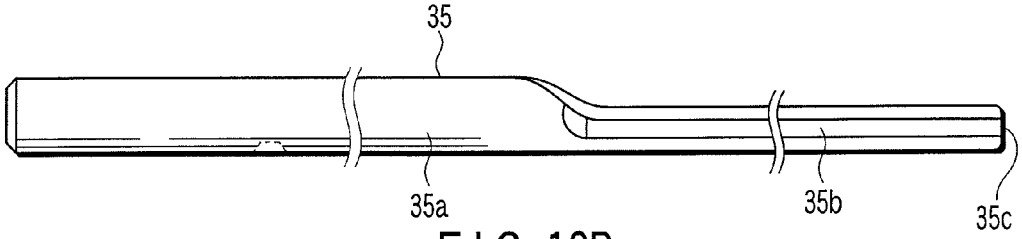
FIG. 10B
FIG. 10C
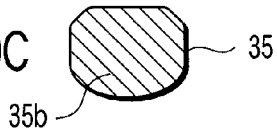

HOLLOW RACK MANUFACTURING METHOD AND MANUFACTURING APPARATUS

CROSS-REFERENCE TO RELATED APPLICATIONS

This application is based upon and claims the benefit of priority from prior Japanese Patent Applications No. 2007-073622, filed Mar. 20, 2007; No. 2007-073623, filed Mar. 20, 2007; and No. 2007-073624, filed Mar. 20, 2007, the entire contents of all of which are incorporated herein by reference.

BACKGROUND OF THE INVENTION

1. Field of the Invention

The present invention relates to a method and an apparatus for manufacturing a hollow rack for use as a steering rack in a steering system of a vehicle, for example, an automobile.

2. Description of the Related Art

Conventionally, there has been known a method and an apparatus for forming a rack corresponding to the tooth profile of a die at a flat tooth profile processing portion of a pipe material by inserting or removing a long rod-like metal core having a plurality of expanded diameter sections into/from the pipe material held by dies composed of an upper die and a lower die through openings at both ends alternately (for example, patent document 1: paragraphs [0023] to [0027] and FIG. 4 of Jpn. Pat. Appln. KOKAI Publication No. 2002-86243).

Further, there has been known a method and an apparatus for, by using a metal core push rod to be inserted/removed into/from an iron pipe held by a die assembly composed of an upper die and a lower die alternately through openings on both ends, forming the rack corresponding to the tooth profile of the die in an iron pipe by pressing the metal core much shorter than the push rod into the iron pipe (for example, patent document 2: paragraphs [0022] to [0037] and FIGS. 1 to 9 of Jpn. Pat. Appln. KOKAI Publication No. 2006-26703).

More specifically, according to the patent document 2, an iron pipe having a flat tooth profile processed portion compressed into a semi-crescent shape is held between an upper die having the tooth profile portion and a lower die. Next, each of plural metal cores supported by metal core accommodation portions disposed on both sides of the die assembly is pressed into the iron pipe successively by the metal core push rods which are inserted/removed into/from the iron pipe alternately from both sides of the die assembly.

In pressing in, the metal core push rod inserted into the iron pipe presses a single metal core pulled out of the metal core accommodation portion up to a state in which it passes through the tooth profile of the upper die completely. Next, at the same time when one of the metal core push rods is retreated, the other metal core push rod pulls out other metal core from the other metal core accommodation portion and presses it into the iron pipe. The metal core pulled out of the metal core accommodation portion on one side by the metal core push rod and pressed into the iron pipe, is pushed back by the other metal core push rod through the other metal core and returned to the metal core accommodation portion on the one side. When the metal cores are pressed into the iron pipe alternately, a projection provided at the front end of the metal core push rod is engaged with an oval depression provided in an end face of the metal core pressed by the metal core push rod so as to stop rotation of the metal core.

By pressing the metal core into the iron pipe from the right and left side alternately, the fabric of a portion to be processed into the tooth profile of the iron pipe is fluidized plastically toward a tooth profile outside from inside of the iron pipe so as to form a rack corresponding to the tooth profile in the iron pipe.

The metal core accommodation portion and the tooth profile of the die assembly are discontinuous and the metal core accommodated in the metal core accommodation portion is supported by a spring so that it is not moved from the accommodation position unexpectedly due to vibration or the like. Thus, although the metal core and the metal core push rod are stopped from rotating by engagement between the oval depression and the projection, there is a fear that the metal core may slip out of the metal core push rod due to a force exerted when it is pushed out of the metal core accommodation portion by the metal core push rod. If the metal core is pressed by the metal core push rod with stoppage of rotation of the metal core released, the metal core might rotate freely around its axis. As a result, the metal core is pressed into the iron pipe with an appropriate posture of the metal core with respect to the portion to be processed into the tooth profile of the iron pipe, not only does a processing failure occur, but also an excessive load is generated at that time, thereby possibly damaging the manufacturing apparatus.

According to the technology of the patent document 2, the other metal core already pressed in is pushed back by the metal core to be pressed in contact with the metal core push rod inserted into the iron pipe. However, the metal cores are not formed into a structure preventing them from rotating with respect to each other. Additionally, the other metal core to be pushed back is pressed into a position where it has passed the tooth profile portion completely. Thus, the other metal core to be pushed back rotates freely around its axis thereby likely an appropriate positional relationship with the tooth profile processed portion of the iron pipe being degraded. Then, the tooth profile processed portion of the iron pipe is restored to some extent after fluidized plastically and the other metal core is pushed back through that portion. Thus, not only does a processing failure occur but also there is a possibility that an excessive load may be generated thereby damaging the manufacturing apparatus.

According to the technology of the patent document 1 using the long rod-like metal core, when the long metal core pushed into the pipe member is pulled back, the metal core can be broken due to a load applied by the tooth profile processed portion sprung back.

Further, to insert/remove the long rod-like metal core into/from the pipe material alternately, a driving portion having a capacity which applies a pressure for inducing the plastic fluidity is needed for each long rod-like metal core and these driving portions are disposed on both sides of the die assembly. Usually, a hydraulic cylinder is used in a pair of the driving portions. Thus, the manufacturing apparatus is of large scale.

In a pair of the hydraulic cylinders which constitute the driving portion, a long rod-like metal core is connected to their cylinder rods and the metal core is moved in a direction of extension of its axis. Further, the hydraulic cylinder on one side needs to be disposed with an interval longer than the length of the pipe material secured with respect to the die assembly. By considering a moving distance of the cylinder rod of each of the pair of the hydraulic cylinders, installation space for the manufacturing apparatus is determined. Thus, the manufacturing apparatus described in the patent document 1 is disadvantageous in its large scale and its large installation space.

Contrary to this, according to the technology of the patent document 2, the possibility that the metal core may be broken is low because it is much shorter.

However, the manufacturing apparatus described in the patent document 2 requires a pair of driving portions constituted of hydraulic cylinder on both sides of the die assembly in order to reciprocate the pair of the metal core push rods for pressing in the metal core from the right and left sides of the pipe material alternately. Thus, the manufacturing apparatus is of large scale.

The manufacturing apparatus described in the patent document 2 is advantageous for reducing the installation space as compared with the manufacturing apparatus described in the patent document 1. However, because a pair of the driving portions constituted of a hydraulic cylinder for reciprocating the metal core push rod are disposed on both sides of the die assembly, there is a room for improvement in reduction of the apparatus size.

According to the technology described in the patent document 2, a rack corresponding to the tooth profile of the die assembly can be formed by fluidizing the fabric of the tooth profile processed portion of the pipe material plastically outward from inside of the pipe material. According to such a manufacturing method, the tooth profile processed portion is inevitably attached to the tooth die and thus, the processed pipe material needs to be separated from the tooth profile and taken out of the die assembly.

However, the patent document 2 describes nothing about the technology of removing the pipe material attached to the upper die of the die assembly.

To separate a formed product attached to the upper die of the die assembly in various pressing units, a technology for building a knock out unit in the die assembly has been known.

This knock out unit is constituted of a plurality of knock out bars provided on the die assembly and driving means such as a hydraulic cylinder which pushes or pulls these bars with respect to the surface of the upper die. By building such a knock out unit in the upper die of the die assembly of the hollow rack manufacturing apparatus, the work of separating the pipe material attached to the upper die from the upper die can be automated.

However, building the knock out unit into the die assembly inevitably complicates the structure of the die assembly and accompanied by this, die assembly cost is increased and maintenance of the die assembly is more troublesome.

BRIEF SUMMARY OF THE INVENTION

An object of the present invention is to provide a method and an apparatus for manufacturing a hollow rack with processing failure and damage on the apparatus suppressed while increasing reliability of stoppage of rotation with respect to the metal core.

A method for manufacturing a hollow rack according to the invention comprises: holding a metallic hollow material having open both ends and having a processing wall portion in which a rack is to be formed by means of a tooth die within a die assembly having the tooth die; with a first metal core push rod which is to be inserted into/removed from the hollow material through an opening at one end of the material and a second metal core push rod which is to be inserted into/removed from the hollow material through an opening at the other end, sandwiching a metal core disposed on only a side in which the first metal core push rod is inserted into/removed from the die assembly, stopping rotation of the metal core at least with the first metal core push rod, and with the rotation of the metal core stopped, introducing the metal core into the hollow material from the opening at the one end by both the metal core push rods; after pressing the metal core into the hollow material with the rotation of the metal core stopped by the first metal core push rod, pushing back the metal core by the second metal core push rod while sandwiching the metal core between the second metal core push rod and the first metal core push rod; and plastically fluidizing the fabric of the processing wall portion adjoining the tooth die outward from inside of the hollow material so as to form a rack corresponding to the tooth die.

A hollow rack manufacturing apparatus according to the invention comprises: a die assembly which has a tooth die and holds a metallic hollow material having open both ends and having a processing wall portion in which a rack is to be formed by means of the tooth die; a plurality of metal cores each having an end formed into a rotation stop face and the other end formed into a flat surface so as to form a rack corresponding to the tooth die by plastically fluidizing the processing wall portion in contact with the tooth die outward from inside of the hollow material when each metal core is pressed into the hollow material successively; a metal core holder which is disposed on only one side of the die assembly in order to support the metal core with the other end formed into the flat surface directed toward the die assembly so that the metal core is moved to a position which allows the metal core to be inserted into an opening at one end of the hollow material held by the die assembly; a first metal core push rod which has a front end formed into a rotation stop face, the front end engaging an end formed into the rotation stop face for the metal core, and is inserted into/removed from the hollow material through an opening at the one end of the metal core holder and the hollow material so that the metal core is pressed into the hollow material while stopping rotation of the metal core by the insertion; and a second metal core push rod which is inserted into/removed from the hollow material through the opening at the other end from an opposite side to the first metal core push rod, presses the metal core from the metal core holder into the hollow material while the metal core is sandwiched together with the first metal core push rod, and pushes back the metal core toward the metal core holder.

Because the method and apparatus for manufacturing the hollow rack of the present invention have a high reliability of stoppage of rotation with respect to the metal core, processing failure and damage on the apparatus can be suppressed when manufacturing the hollow rack.

An object of the present invention is to provide a method and an apparatus for manufacturing the hollow rack which allow the driving portion for moving the metal core to be constructed in a small size so as to achieve a reduced size of the apparatus.

A method for manufacturing a hollow rack according to the invention comprises: holding a metallic hollow material having open both ends and having a processing wall portion in which a rack is to be formed by means of a tooth die within a die assembly having the tooth die; with a first metal core push rod which is to be inserted into/removed from the hollow material through an opening at one end of the material and a second metal core push rod which is to be inserted into/removed from the hollow material through an opening at the other end, sandwiching the metal core disposed on only a side in which the first metal core push rod is to be inserted into/removed from the die assembly; connecting a first connecting member which is moved together with the first metal core push rod and a second connecting member which is moved together with the second metal core push rod so as to maintain a state of sandwiching the metal core by the first and second metal core push rods; moving the first and second metal core push rods interlockingly in the same direction so as to introduce the metal core into the hollow material through the opening at the one end with this condition, pressing the metal core into the hollow material by means of the first metal core push rod and then pushing back the metal core by means of the second metal core push rod; and plastically fluidizing the fabric of the processing wall portion adjoining the tooth die outward from inside of the hollow material so as to form the rack corresponding to the tooth die.

A hollow rack manufacturing apparatus according to the invention comprises: a die assembly which has a tooth die and holds a metallic hollow material having open both ends and having a processing wall portion in which a rack is to be formed by means of the tooth die; a plurality of metal cores for forming a rack corresponding to the tooth die by plastically fluidizing the processing wall portion adjoining the tooth die outward from inside of the hollow material when each metal core is pressed into the hollow material successively; a metal core holder which is disposed only on one side of the die assembly so as to support the metal core and moves the metal core to a position which allows the metal core to be inserted into the opening at one end of the hollow material held by the die assembly; a first metal core push rod which is to be inserted into/removed from the hollow material through the opening at the one end of the metal core holder and the hollow material so as to press the metal core into the hollow material by the insertion; a second metal core push rod which is to be inserted into/removed from the hollow material through the opening at the other end from an opposite side to the first metal core push rod and, with the metal core sandwiched together with the first metal core push rod, presses the metal core from the metal core holder into the hollow material while pushing back the metal core toward the metal core holder; a first connecting member which is moved together with the first metal core push rod; a second connecting member which is moved together with the second metal core push rod; connecting means for maintaining a state of the metal core sandwiched by the first and second metal core push rods by connecting the first and second connecting members; and a single driving portion which reciprocates the first and second metal core push rods interlockingly in the same direction so as to press the metal core into the hollow material with the first metal core push rod and push back the metal core with the second metal core push rod with the first and second connecting members connected to each other.

According to the method and apparatus for manufacturing the hollow rack of the present invention, the driving portion for reciprocating the first and second metal core push rods which sandwich the metal core is shared by both the metal core push rods. Consequently, the driving portion for moving the metal core can be constructed in a small size so as to achieve downsizing of the apparatus.

An object of the present invention is to provide a method and an apparatus for manufacturing the hollow rack which allow a hollow material in which the rack is formed to be separated from the upper die of the die assembly without accompanying complexity of the die assembly structure.

A method for manufacturing a hollow rack according to the invention comprises: holding a metallic hollow material having a processing wall portion in which a rack is to be formed with a tooth die at a portion near an end portion in a die assembly having an upper die having a downward directed tooth die and a lower die, such that the tooth die is brought into contact with the processing wall portion while a portion at the other end of the hollow material is projected sideway of the die assembly; plastically fluidizing the fabric of the processing wall portion outward from inside of the hollow material with the metal core pressed into the hollow material so as to form a rack corresponding to the tooth die; and pressing down the portion at the other end of the hollow material projected from the die assembly from above with the die assembly opened so as to separate the hollow material having the formed rack from the upper die and then taking the hollow material out of the die assembly.

A hollow rack manufacturing apparatus according to the invention comprises: a die assembly which includes an upper die having a downward directed tooth die and a lower die and holds a metallic hollow material having a processing wall portion in which a rack is to be formed with the tooth die at a portion near an end portion, such that a portion at the other end of the hollow material is projected sideways of the die assembly; a plurality of metal cores which plastically fluidize the processing wall portion adjoining the tooth die outward from inside of the hollow material when each metal core is pressed into the hollow material so as to form a rack corresponding to the tooth die; and a separating mechanism which is provided outside the die assembly and has a separating member coming into contact with the portion at the other end of the hollow material projecting out of the die assembly from above with the die assembly opened so as to separate the hollow material in which the rack is formed from the upper die.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 4 is a conceptual diagram showing the manufacturing apparatus with the metal core pressed in;

FIG. 9A is a plan view showing a first metal core push rod provided in the manufacturing apparatus;

FIG. 9B is a side view showing the first metal core push rod;

FIG. 9C is a sectional view taken along the line F9C-F9C in FIG. 9A of the first metal core push rod;

FIG. 10A is a plan view showing a second metal core push rod provided in the manufacturing apparatus;

FIG. 10B is a side view showing the second metal core push rod;

FIG. 10C is a sectional view taken along the line F10C-F10C in FIG. 10A of the second metal core push rod;

DETAILED DESCRIPTION OF THE INVENTION

A manufacturing apparatus 11 for carrying out a manufacturing method according to a first embodiment of the present invention will be described with reference to FIGS. 1A to 12.

Figure 1A:
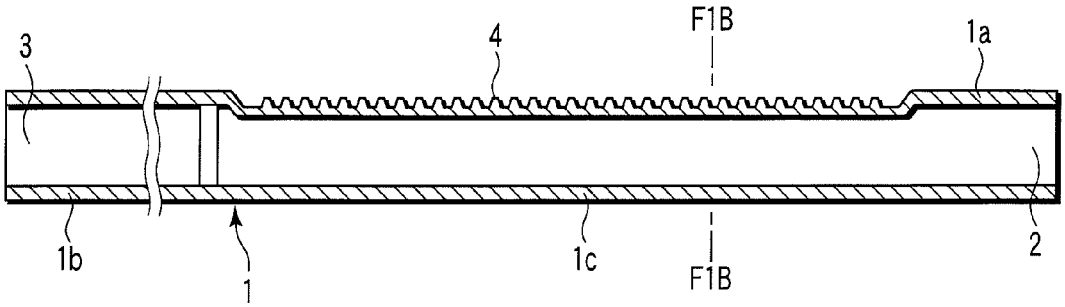
FIG. 1A is a sectional view showing a hollow rack manufactured by a manufacturing apparatus which carries out a manufacturing method according to a first embodiment of the present invention.
Figure 1B:
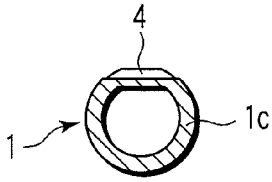
FIG. 1B is a sectional view taken along the line F1B-F1B in FIG. 1A which is the diagram of the hollow rack.

Reference number 1 in FIGS. 1A and 1B denotes a hollow rack (hereinafter abbreviated as rack) for use as a hollow steering rack of an automotive power steering unit. This rack 1 is a half-finished product processed by the manufacturing apparatus 11 and subjected to a necessary post processing in a next step.

Both ends of the rack 1 in a direction in which its axis extends (hereinafter called axial direction) are opened. An opening at an end of the rack 1 is designated with reference number 2 and an opening at the other end is designated with reference number 3. An engagement portion 4 is formed on the outer face of a portion near the opening 2 at one end of the rack 1. This engagement portion 4 is formed by arranging a plurality of rack teeth. Portions 1*a* and 1*b* off the engagement portion 4 in the axial direction of the rack 1 have a cylindrical section. A portion 1*c* provided with the engagement portion 4 in the axial direction of the rack 1 has a non-cylindrical section as shown in FIG. 1B.

The rack 1 is manufactured by processing a metallic hollow material, for example, a straight steel pipe 1A with the manufacturing apparatus 11 shown in FIGS. 2 to 8. Both ends in the axial direction of the steel pipe 1A are open and the opening at one end thereof is the same as the opening 2 at one end of the rack 1 while the opening at the other end of the steel pipe 1A is the same as the opening 3 at the other end of the rack 1.

Figure 5:
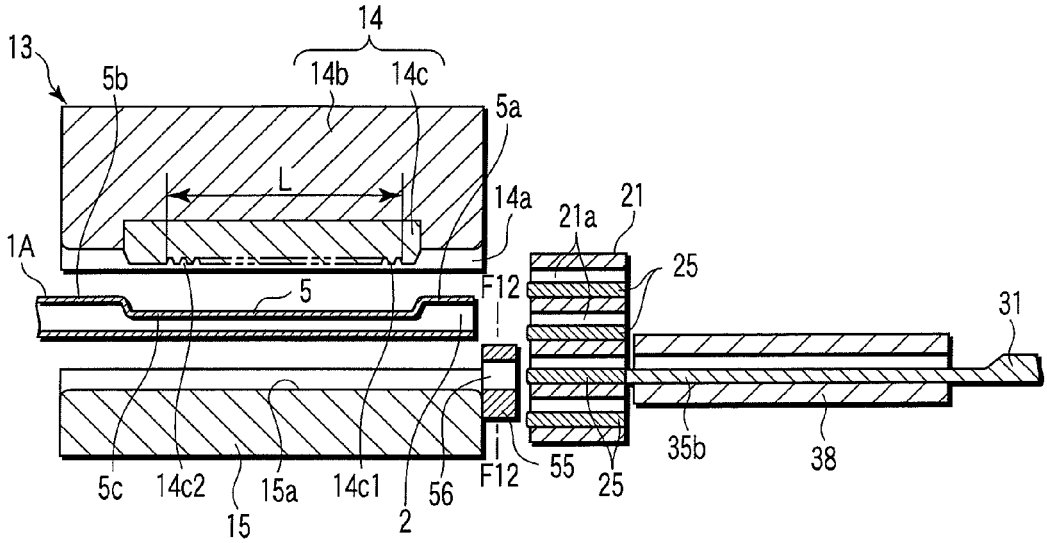
FIG. 5 is a sectional view showing the dies of the manufacturing apparatus and the periphery of a metal core holder with the dies opened.

As shown in FIG. 5, a processing wall portion 5 is formed at a portion near the opening 2 at one end of the steel pipe 1A. The engagement portion 4 is formed on the outer face of this processing wall portion 5. The processing wall portion 5 is provided by compressing part of the pipe wall of the steel pipe 1A inward of the steel pipe 1A so as to obtain a flat surface by pressing.

Figure 2:
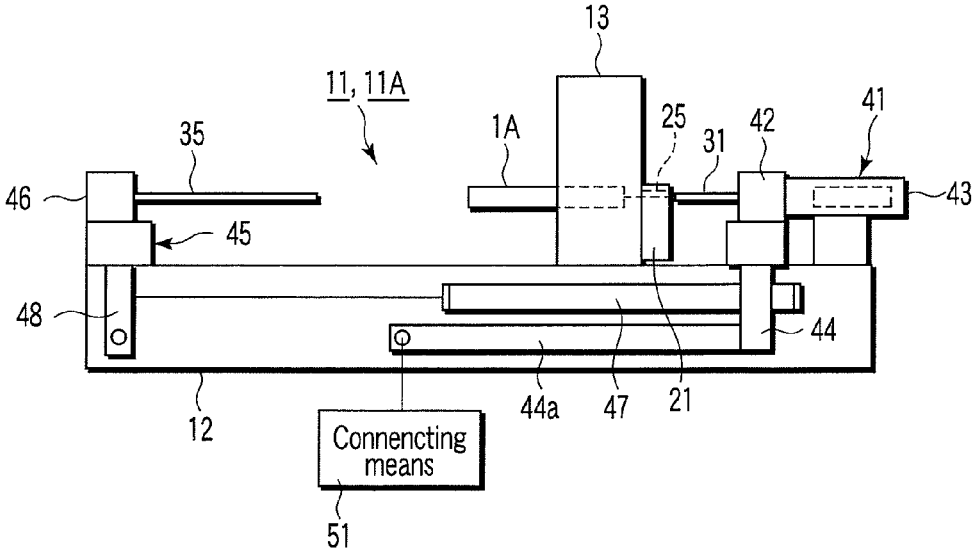
FIG. 2 is a conceptual diagram showing an example of the manufacturing apparatus in a waiting condition.
Figure 3:
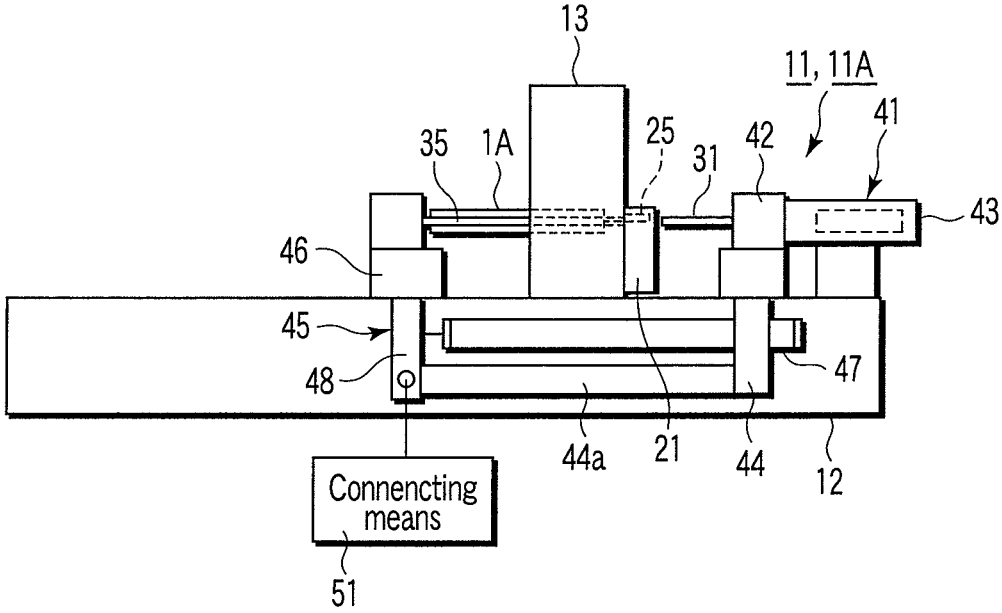
FIG. 3 is a conceptual diagram showing the manufacturing apparatus with a metal core being transferred.
Figure 4:
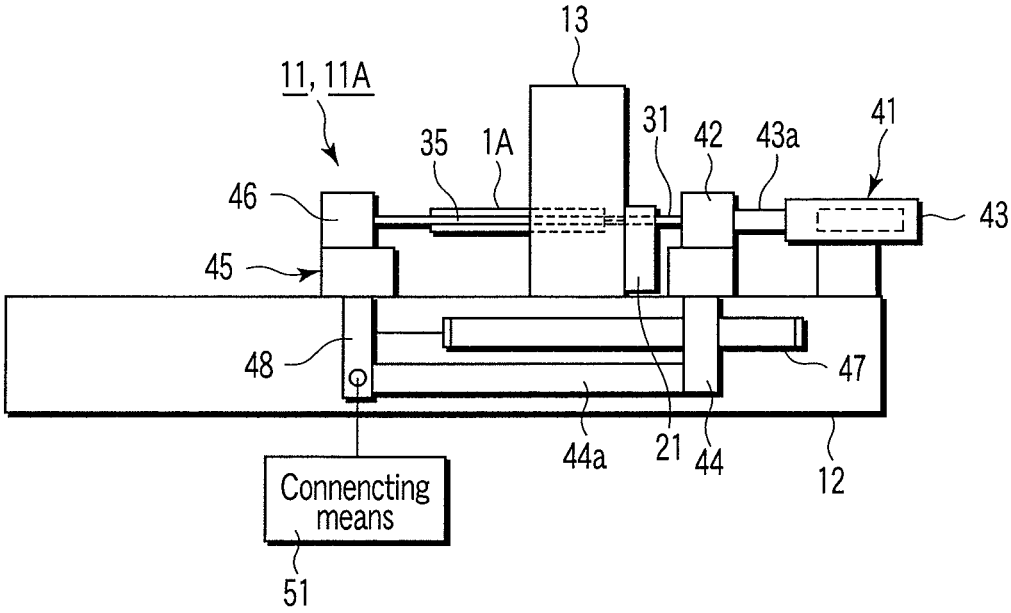

As shown in FIGS. 2 to 4, the manufacturing apparatus 11 for the hollow rack includes a base 12, a die assembly 13, a metal core holder 21, a plurality of metal cores 25, a first metal core push rod 31, a second metal core push rod 35, first push rod driving means 41, second push rod driving means 45, connecting means 51, a metal core guide 55 (see FIG. 5) and the like.

The die assembly 13 is installed on the base 12. The die assembly 13 includes an upper die 14 and a lower die 15 as shown in FIGS. 5 to 8 and contains a die clamping mechanism (not shown). The lower die 15 is fixed to the base 12 and has a set groove 15*a* provided in the top face. The upper die 14 is clamped from above to and opened from the lower die 15 by the die clamping mechanism.

In the upper die 14, a tooth die 14*c* is mounted detachably to an upper die base 14*b*. The upper die base 14*b* has a set groove 14*a* provided on its bottom face. With the dies clamped, the set grooves 14*a*, 15*a* are matched so as to sandwich the steel pipe 1A from up and down. The bottom end portion of the tooth die 14*c* is projected between both end portions in the length direction of the set groove 14*a*. Downward directed teeth are formed on the bottom end portion of the tooth die 14*c*.

The metal core holder 21 is disposed on one side of the die assembly 13, for example, on the right side of the die assembly 13 in FIGS. 2 to 8. The metal core holder 21 has a plurality of holding holes 21*a* as shown in FIGS. 5 to 8. These holding holes 21*a* penetrate the metal core holder 21 in the direction in which the set grooves 14*a*, 15*a* extend and the metal core 25 is accommodated therein. Each metal core 25 supported by the metal core holder 21 is positioned on a side in which the first metal core push rod 31 is inserted into/removed from the die assembly 13.

The metal core holder 21 is moved by a holder driving portion (not shown). Each time this drive is performed, one of the plural holding holes 21*a* is selected successively and placed to oppose an end of a hole formed by the set grooves 14*a*, 15*a* matched with each other. Thus, the metal core 25 supported by the metal core holder 21 can be inserted into/removed from the steel pipe 1A successively. To this end, according to this embodiment, the metal core holder 21 is moved by the holder driving portion every constant pitch vertically (in a vertical direction) in FIGS. 5 to 8. However, it may be moved sideways (in the front face to rear face direction of paper in FIGS. 5 to 8). Alternatively, it is permissible to provide the metal core holder 21 rotatably and rotate it every predetermined angle by the holder driving portion.

Each metal core 25 is formed of metal. The metal core 25 is subjected to processing of increasing its hardness and abrasion resistance as compared with the steel pipe 1A. The length of the metal core 25 is smaller than half the length of the tooth portion of the tooth die 14*c* indicated with reference symbol A in FIG. 5. As shown in FIG. 1C, the shape of the metal core 25 as seen from its end face is composed of a circular bottom face along the inner periphery of the steel pipe 1A, a pair of substantially parallel straight side faces continuous upward from both ends of this bottom face and a top face connecting the top ends of these side faces.

Figure 11A:
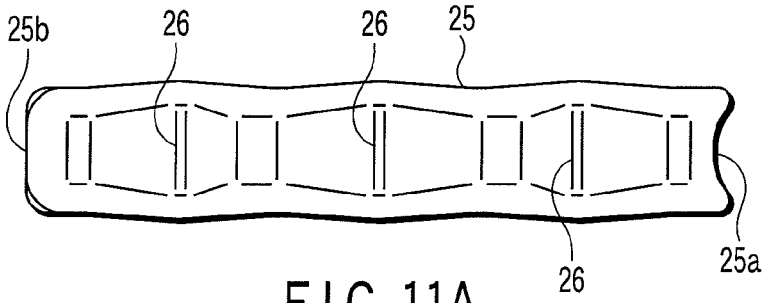
FIG. 11A is a plan view showing a metal core provided in the manufacturing apparatus.
Figure 11B:
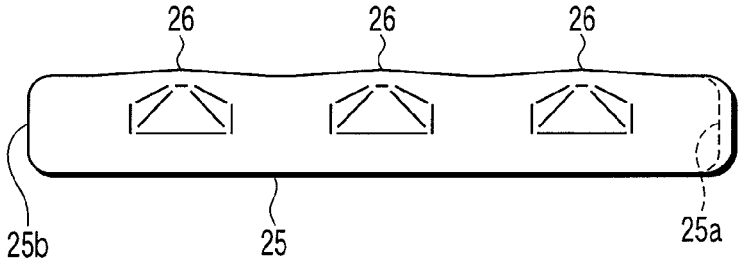
FIG. 11B is a side view showing the same metal core.

As shown in FIGS. 11A and 11B, the metal core 25 has a plurality of, for example, three convex portions 26 arranged in the length direction. These convex portions 26 are formed such that tapered faces are provided on both sides of its apex. The heights of the convex portions 26 of each metal core 25 to be accommodated in the metal core holder 21 differ. Taking in/out of the metal core 25 with respect to the metal core holder 21 upon processing is carried out in order from the metal core 25 having a relatively low convex portion 26.

An end 25*a* in the length direction of the metal core 25 is formed into a rotation stop face. The other end 25*b* in the length direction of the metal core 25 is formed of a flat plane perpendicular to the length direction of the metal core 25. The rotation stop face of the metal core 25 is formed in a concave curved face which is extended in the thickness direction of the metal core 25 (vertical direction in FIG. 11B) while both ends are open. Thus, both ends of the concave portion defined by the concave curved face are open to both top and bottom faces of the metal core 25. In the meantime, the rotation stop face defining the end 25*a* may be formed of a concave face, for example, concave curved face extending in the width direction (vertical direction in FIG. 11A) of the metal core 25 while both ends are open. Further, the rotation stop face may be formed in a convex portion, for example, convex curved face extending in the thickness or width direction of the metal core 25 instead of the concave curved face. The end 25*a* may be formed in a V-shaped concave face or a convex face extending in the thickness direction or the width direction of the metal core 25.

The metal core 25 is accommodated in each holding hole 21*a* in the metal core holder 21 individually such that the other end 25*b* defined by the flat face is directed to the die assembly 13. The accommodated metal core 25 is held in an appropriate posture with respect to the die assembly 13 by a leaf spring or the like (not shown) so that it is prevented from slipping out carelessly.

The first metal core push rod 31 is formed of metal and has a proximal portion 31*a* having a circular section and an insertion shaft portion 31*b* as shown in FIGS. 9A and 9B. The insertion shaft portion 31*b* is inserted into and removed from the steel pipe 1A. The shape of the section perpendicular to the axial direction of this insertion shaft portion 31*b* is shown in FIG. 9C and substantially the same as or smaller than the sectional shape in a direction perpendicular to the length direction of the minimum metal core 25.

A front end 31*c* of the insertion shaft portion 31*b* has a rotation stop face for preventing the metal core 25 from rotating around the axis. This rotation stop face is formed of a concave face, for example, concave curved face extending in the thickness direction (in the vertical direction in FIGS. 9B and 9C) of the insertion shaft portion 31*b*. The front end 31*c* of the insertion shaft portion 31*b* is engaged with an end 25*a* which forms a rotation stop face for the metal core 25 by movement in the axial direction of the first metal core push rod 31. In the meantime, the rotation stop face which defines the front end 31*c* may be formed of a convex face, for example, a convex curved face extending in the width direction (right-left direction in FIG. 9C) of the insertion shaft portion 31*b*. Further, the rotation stop face may be formed of a concave face, for example, a concave curved face extending in the thickness direction or the width direction of the insertion shaft portion 31*b* instead of the convex curved face.

As shown in FIGS. 2 to 4, the first push rod driving means 41 includes a first moving base 42, a first driving portion 43 and a first connecting member 44.

The first moving base 42 is mounted on the base 12 for example, on the right side with respect to the die assembly 13 such that it can be moved in a direction of approaching/leaving the die assembly 13 in FIGS. 2 to 4. The first driving portion 43 is fixed at an end portion in the length direction of the base 12 with the first moving base 42 interposed between the first driving portion 43 and the die assembly 13. The first driving portion 43 has a driving source (not shown) and a connecting rod 43*a* (see FIG. 4) which is reciprocated by a drive force of this driving source. The front end portion of the connecting rod 43*a* is connected to the first moving base 43 from an opposite side to the die assembly 13. As a driving source of the first driving portion 43, for example, a servo motor may be used preferably.

The first push rod driving means 41 can advance the first moving base 42 toward the die assembly 13 or retract the first moving base 42 in a direction away from the die assembly 13 by changing the operating direction of the first driving portion 43.

The first moving base 42 supports the proximal portion 31*a* of the first metal core push rod 31 detachably. Thus, by reciprocating the first moving base 42, the insertion shaft portion 31*b* of the first metal core push rod 31 is inserted into/removed from the steel pipe 1A held by the die assembly 13. At that time, the insertion shaft portion 31*b* is inserted into the steel pipe 1A held by the die assembly 13 accompanying the metal core 25 which engages the front end 31*c*. In the meantime, reference number 38 in FIGS. 5 to 8 indicates a tubular push rod guide disposed between the first moving base 42 and the metal core holder 21. This push rod guide 38 introduces the insertion shaft portion 31*b* into the holding hole 21*a* in the metal core holder 21.

As shown in FIG. 5, an end portion in the length direction of the tooth die 14*c* positioned on the insertion side of the first metal core push rod 31 into the die assembly 13 is called first tooth die end portion 14*c*1, and the other end portion in the length direction of the tooth die 14*c* positioned on the insertion side of the second metal core push rod 35 into the die assembly 13 is called second tooth die end portion 14*c*2. In addition, in a state that the steel pipe 1A is held in the die assembly 13, an end portion in the length direction of the processing wall portion 5 with which the first tooth die end portion 14*c*1 makes contact is called first portion 5*a* and the other end portion in the length direction of the processing wall portion 5 with which the second tooth die end portion 14*c*2 makes contact is called second portion 5*b*.

Figure 8:
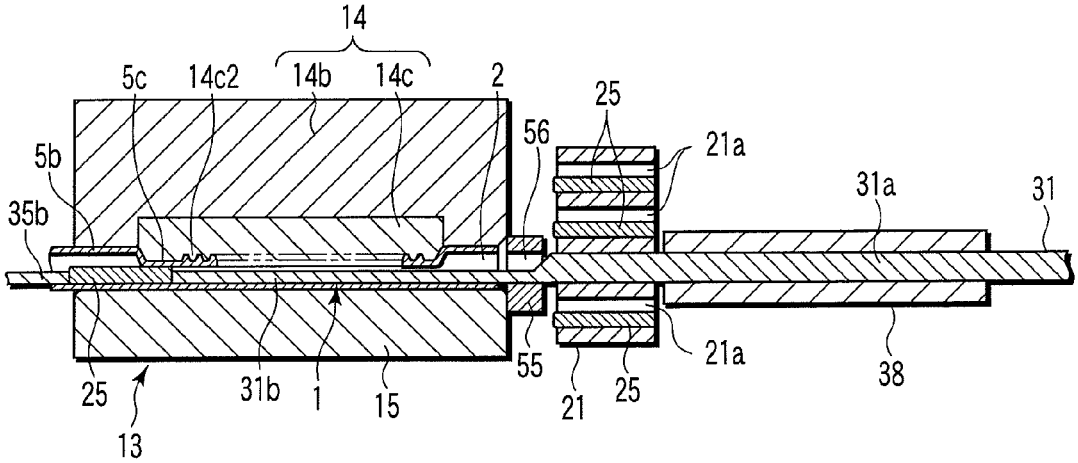
FIG. 8 is a sectional view showing the dies of the manufacturing apparatus and the periphery of the metal core holder with pressing in of the metal core completed.

The pushing depth of the metal core 25 to the steel pipe 1A is stipulated as follows. More specifically, the metal core 25 pressed into the steel pipe 1A by the first metal core push rod 31 is stopped in contact with a portion 5*c* positioned off the tooth die 14*c* on the insertion side of the second metal core push rod 35 of the processing wall portion 5 in contact with the tooth die 14*c*. This stipulated pushing depth is achieved under the control of the first driving portion 43 and FIG. 8 shows a state in which the metal core 25 has reached such a pushing depth. In this condition, the metal core 25 is sandwiched by the portion 5*c* near the second portion 5*b* of the processing wall portion 5 and the bottom wall portion of the steel pipe 1A positioned just below in a vertical direction.

The first connecting member 44 is connected to the first moving base 42. The first connecting member 44 is disposed within the base 12 and has a front end portion 44*a* projecting toward the other end portion in the length direction of the base 12.

The second metal core push rod 35 is formed of metal and has a proximal shaft portion 35*a* having a circular section and an insertion shaft portion 35*b* as shown in FIGS. 10A and 10B. The insertion shaft portion 35*b* is a portion to be inserted into/removed from the steel pipe 1A. The shape of the section perpendicular to the axial direction of the insertion shaft portion 35*b* is shown in FIG. 10C and like the section of the first metal core push rod 31, substantially the same as or smaller than the sectional shape in a direction perpendicular to the length direction of the minimum metal core 25.

A front end 35*c* of the insertion shaft portion 35*b* is formed of a flat face perpendicular to the axis of the insertion shaft portion 31*b*. This front end 35*c* makes contact with/departs from the other end 25*b* of the metal core 25 when the second metal core push rod 35 is moved in the axial direction.

As shown in FIGS. 2 to 4, the second push rod driving means 45 includes a second moving base 46, a second driving portion 47 and a second connecting member 48.

The second moving base 46 is installed to the base 12 on the left side of the die assembly 13 such that it can be moved in a direction of approaching/leaving the die assembly 13 in FIGS. 2 to 4. This second moving base 46 is disposed on the other end side in the length direction of the base 12, that is, on an opposite side to the first moving base 42 with respect to the die assembly 13. The second connecting member 48 is connected to the second moving base 46. The second connecting member 48 is disposed within the base 12.

The second driving portion 47 is constructed of for example, an air cylinder and incorporated in the base 12. A piston rod of this air cylinder is connected to the second connecting member 48. This second driving portion 47 advances the second moving base 46 toward the die assembly 13 by drawing the piston rod and retracts the second moving base 46 in a direction away from the die assembly 13 by projecting the piston rod.

The second moving base 46 supports the proximal shaft portion 35*a* of the second metal core push rod 35 detachably. Thus, when the second moving base 46 is reciprocated, the insertion shaft portion 35*b* of the second metal core push rod 35 is inserted into/removed from the steel pipe 1A held by the die assembly 13.

In the meantime, the first metal core push rod 31 and the second metal core push rod 35 are preferred to be configured to include a shear pin in its intermediate portion in the length direction but not of an integral structure as shown in the same Figure. When an excessive load over a predetermined value is applied suddenly, the first metal core push rod 31 and the second metal core push rod 35 including the shear pin allow that shear pin to be destroyed so as to block an over-load from being applied to respective components of the manufacturing apparatus 11.

Reference number 51 in FIGS. 2 to 4 denotes connecting means 51 which is moved by the first driving portion 43 together with the first connecting member 44. This connecting means 51 serves for connecting the first connecting member 44 and the second connecting member 48 and releasing the connection. More specifically, the connecting means 51 applies a connecting member such as a pin (not shown) for connecting the first connecting member 44 and the second connecting member 48 in such a condition in which they are disposed such that they can be connected or removes the connecting member. The application and removal of this connecting member are automatically carried out using a driving power of a motor.

As shown in FIGS. 5 to 8, the metal core guide 55 is disposed between the die assembly 13 and the metal core holder 21 and beside the die assembly 13. This metal core guide 55 is formed of metal or the like and has a through hole 56 penetrating in its thickness direction. The through hole 56 communicates with the opening 2 at an end of the steel pipe 1A held by the die assembly 13. The through hole 56 allows the insertion shaft portion 31*b* of the first metal core push rod 31 to pass and the insertion shaft portion 35*b* of the second metal core push rod 35 to pass.

Figure 12:
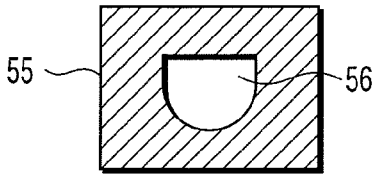
FIG. 12 is a sectional view taken along the line F12-F12 in FIG. 5 of a metal core guide provided in the manufacturing apparatus.

As shown in FIG. 12, the through hole 56 is formed not circularly but into a shape preventing the metal core 25 passing through this through hole 56 from rotating. More specifically, its shape is composed of a circular bottom face, a pair of substantially parallel straight side faces continuous upward from both ends of this bottom face and a flat top face connecting the top ends of the side faces. The circular bottom face of this through hole 56 is formed into substantially the same configuration as the shape of the circular bottom face of the metal core 25 and the height between the bottom face of this through hole 56 and the top face is larger than the thickness of the metal core 25. The pair of the straight side faces of the through hole 56 blocks the metal core 25 passing through the through hole 56 from rotating.

Next, the procedure for manufacturing the hollow rack 1 using the manufacturing apparatus 11 having such a structure will be described.

As shown in FIG. 2, the second moving base 46 is disposed at the other end portion in the length direction of the base 12, that is, at a retreat position and the steel pipe 1A, which is a hollow material is set in the die assembly 13 such that the processing wall portion 5 is directed upward. With the die assembly 13 opened as shown in FIG. 5, this setting work is carried out by clamping the die assembly 13 after the steel pipe 1A held by an automatic setting arm (not shown) is carried into the die assembly 13 from the second moving base 46.

The opening 2 at an end of the set steel pipe 1A is disposed within the die assembly 13 while the other end side of the steel pipe 1A is projected toward the second moving base 46 from the die assembly 13. The portions 5*a* and 5*b* on the both sides of the processing wall portion 5 are sandwiched by the upper die 14 and the lower die 15 in the vertical direction by clamping and the tooth die 14*c* is brought into contact with the outer face of the processing wall portion 5.

By operating the metal core holder 21 before or after this setting work, one of the plural metal cores 25 accommodated therein is held so as to oppose the through hole 56 in the metal core guide 55. At the same time, the front end 31*c* of the first metal core push rod 31 is engaged with the end 25*a* of the metal core 25 opposing the through hole 56.

Next, the second push rod driving means 45 is actuated. That is, the second moving base 46 is brought close to the die assembly 13 by the second driving portion 47. Consequently, the second metal core push rod 35 is inserted into the steel pipe 1A, passing through the opening 3 at the other end of the steel pipe 1A and the second moving base 46 is moved to a connecting position shown in FIG. 3. Accompanied by this, the front end of the insertion shaft portion 35*b* of the second metal core push rod 35 is inserted through the opening 2 at the one end of the steel pipe 1A and the through hole 56 in the metal core guide 55, making contact with the other end 25*b* of the metal core 25 in the metal core holder 21 opposing this through hole 56.

Figure 6:
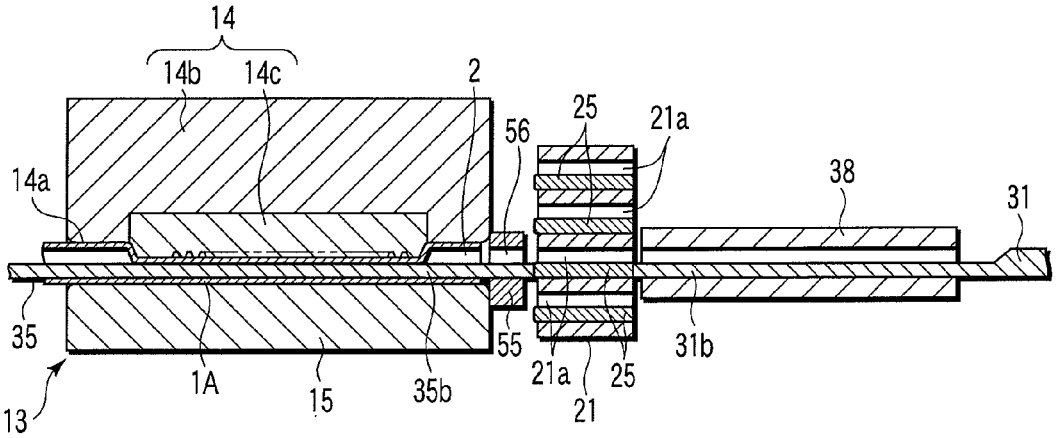
FIG. 6 is a sectional view showing the dies of the manufacturing apparatus and the periphery of the metal core holder with the metal core sandwiched.

Thus, the metal core 25 in the through hole 56 is sandwiched by the first metal core push rod 31 and the second metal core push rod 35, keeping contact with both ends thereof, from both ends in the axial direction. When sandwiched, the end 25*a* of the metal core 25 and the front end 31*c* of the first metal core push rod 31 engage with each other in a convex-concave configuration relationship so that the metal core 25 is kept from rotating. This state is shown in FIG. 6.

The insertion shaft portion 35*b* of the second metal core push rod 35 passing through the steel pipe 1A so as to meet the metal core 25 does not make contact with the inside face of the processing wall portion 5 in the aforementioned process and in other process described later. If it makes contact, that contact is very slight. Therefore, the second driving portion 47 needs no driving force large enough to deform the processing wall portion 5. Therefore, because the driving portion 47 needs no driving force large enough to deform the processing wall portion 5, a cheap air cylinder may be used preferably as this driving portion 47.

When the second moving base 46 is moved to the connecting position shown in FIG. 3 as described above, the second connecting member 48 is disposed to be capable of being connected to the first connecting member 44. With this state, the connecting means 51 is operated. Consequently, because the first connecting member 44 and the second connecting member 48 are connected by a connecting member (not shown), the first metal core push rod 31 and the second metal core push rod 35 come into contact with both ends of the metal core 25 so that the metal core 25 is sandwiched therebetween.

Figure 7:
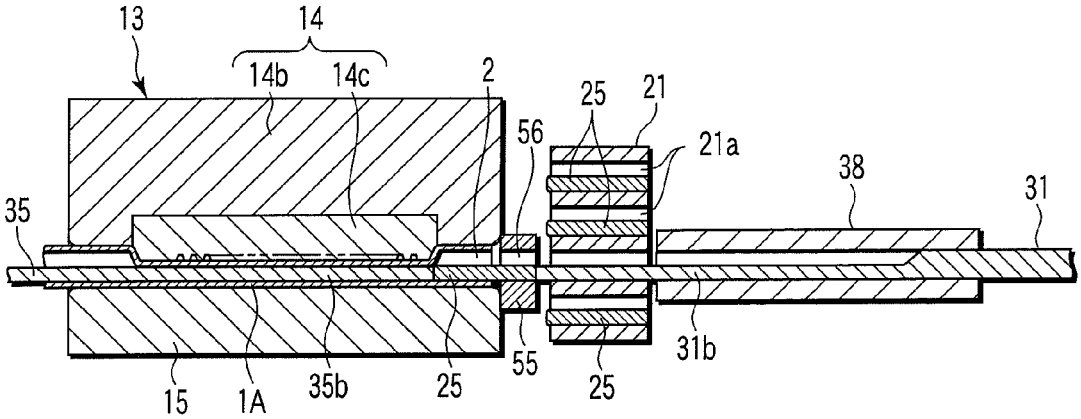
FIG. 7 is a sectional view showing the dies of the manufacturing apparatus and the periphery of the metal core holder with the metal core being transferred.

After that, the first driving portion 43 of the first push rod driving means 41 is operated and the first moving base 42 is reciprocated between the first position shown in FIG. 3 and the second position shown in FIG. 4. When the first moving base 42 is moved (reciprocated) toward the die assembly 13 from the first position to the second position, the first metal core push rod 31 passes through the holding hole 21*a* in the metal core holder 21 and the through hole 56 in the metal core guide 55 and then is inserted into the steel pipe 1A held by the die assembly 13 through the opening 2 at the one end as shown in FIG. 7.

At this time, the second moving base 46 is moved in the same direction as the first moving base 42 synchronously with the first moving base 42. That is, the second moving base 46 is retreated apart from the die assembly 13 interlockingly with the first moving base 42. Thus, the metal core 25 is pressed into the steel pipe 1A by being pushed by the first metal core push rod 31 while it is sandwiched by the first metal core push rod 31 and the second metal core push rod 35.

In this case, the metal core 25 is pressed in with the flat other end 25*b* in the lead. Thus, as compared with pressing in of the metal core 25 into the steel pipe 1A with the end 25*a* composed of the concave curved face of the metal core 25 in the lead, it can be inserted smoothly.

By this pressing in, the plurality of the convex portions 26 of the metal core 25 plastically fluidize the flesh of the processing wall portion 5 of the steel pipe 1A so that it is pressed in from the inside of the steel pipe 1A toward the tooth die 14*c* outside.

In this pressing in, even if the metal core 25 is forced out of the metal core holder 21 violently, the metal core 25 is prevented from departing from the first metal core push rod 31 by the second metal core push rod 35. Thus, the rotation preventing function of the metal core 25 by the first metal core push rod 31 is never lost. Further, the metal core 25 is blocked from rotating by the metal core guide 55 through which it passes in a process of being transferred from the metal core holder 21 to the die assembly 13. Further, the sandwiching state of the metal core 25 by the first metal core push rod 31 and the second metal core push rod 35 is maintained during the pressing in, thereby the metal core 25 being blocked from rotating freely around the axis.

Reliability of stopping the rotation of the metal core 25 is high. Thus, when the posture of the metal core 25 to the processing wall portion 5 is inappropriate, the metal core 25 can be prevented from being pressed into the steel pipe 1A. This prevents a processing failure in the processing wall portion 5 from being generated. Consequently, no excessive load is generated accompanied by the pressing in, thereby enabling the rack to be manufactured without exerting damage to the manufacturing apparatus 11.

The pressing in of the metal core 25 is terminated before the metal core 25 passes through the processing wall portion 5 completely, as shown in FIG. 8. Accompanied by the termination of the pressing in, the metal core 25 is held such that it is sandwiched by the portion 5*c* of the processing wall portion 5 near the second portion 5*b* of the steel pipe 1A and the bottom wall portion of the processing wall portion 5 just below in a vertical direction. Thus, the metal core 25 cannot rotate so that an appropriate positional relationship between the metal core 25 and the processing wall portion 5 is held.

As the first moving base 42 is moved (reciprocated) to leave the die assembly 13 from the second position shown in FIG. 4 to the first position shown in FIG. 3 by the first driving portion 43, the first metal core push rod 31 is pulled back. At this time, the second moving base 46 is moved in the same direction as the first moving base 42 synchronously with the first moving base 42. That is, because the second moving base 46 is brought close to the die assembly 13 synchronously with the first moving base 42, the second metal core push rod 35 is moved toward the metal core holder 21.

Consequently, the metal core 25 is pushed back into the metal core holder 21 through the opening 2 at the one end of the steel pipe 1A and the through hole 56 in the metal core guide 55 by the second metal core push rod 35 in a condition in which the same metal core 25 is sandwiched by the first metal core push rod 31 and the second metal core push rod 35 keeping contact with both ends thereof.

In this case also, the plurality of the convex portions 26 of the metal core 25 plastically fluidize the flesh of the processing wall portion 5 of the steel pipe 1A such that it is pressed into the tooth die 14*c* outside from inside of the steel pipe 1A. Further, because reliability of stopping the rotation of the metal core 25 is high like when it is pressed in first, the metal core 25 can be accommodated in the through hole 56 with an appropriate posture. Accompanied by this, the metal core 25 interferes with the metal core holder 21 to inhibit application of an excessive load on the metal core holder 21.

After that, by moving the metal core holder 21, the metal core 25 having a next largest sectional area and the holding hole 21*a* accommodating this are set to oppose the opening 2 at the one end of the steel pipe 1A through the through hole 56 in the metal core guide 55. In this case, connection of the first connecting member 44 and the second connecting member 48 is released and one of the first driving portion 43 and the second driving portion 47 is driven to make the first metal core push rod 31 or the second metal core push rod 35 leave the metal core 25, thereby releasing the sandwiching state of the metal core 25. As a result, the metal core holder 21 can be moved without being disturbed by the first connecting member 44 or the second connecting member 48, so as to select a metal core 25 for use next time.

Next, after the metal core 25 for use next time is sandwiched by the first connecting member 44 and the second connecting member 48, the first push rod driving means 41 is operated again so as to reciprocate the first connecting member 44 and the second connecting member 48 synchronously. By repeating this procedure, the rack 1 having the engagement portion 4 corresponding to the tooth die 14*c* of the die assembly 13 is manufactured.

Finally, after the metal core 25 used last is returned to the metal core holder 21, the second metal core push rod 35 is pulled out of the rack 1 and then, the die assembly 13 is opened. After that, the hollow rack 1 is taken out of the die assembly 13 by an automatic set arm.

When reciprocating the first metal core push rod 31 and the second metal core push rod 35 interlockingly with the first driving portion 43, the second driving portion 47 composed of an air cylinder may be opened to the air. Consequently, the second driving portion 47 composed of an air cylinder never acts as an air brake to the motion of the first metal core push rod 31 and the second metal core push rod 35 which interlock with each other.

In the above-described procedure, the manufacturing apparatus 11 for manufacturing the rack 1 can manufacture the hollow rack 1 by preventing a processing failure of the engagement portion 4 to the processing wall portion 5 of the steel pipe 1A and damage of the manufacturing apparatus 11 accompanied by this processing.

In this manufacturing apparatus 11, by moving the first metal core push rod 31 and the second metal core push rod 35 in the same direction synchronously, the metal core 25 sandwiched therebetween is reciprocated. Consequently, the first push rod driving means 41 is used commonly in order to press the metal core 25 into the steel pipe 1A, so that no driving source having a driving power large enough to press the second metal core push rod 35 into the steel pipe 1A is required. Thus, the apparatus can be configured simply. Further, because the metal core 25 is moved by synchronizing the first metal core push rod 31 with the second metal core push rod 35, the motion timing of the first metal core push rod 31 and the second metal core push rod 35 can never be messed up.

The end 25*a* which serves as a face for stopping the rotation of the metal core 25 for use in the manufacturing apparatus 11 does not have any hole but is formed in a concave face, for example, concave curved face. Thus, the metal core 25 has a simple structure and is easy to produce at a low cost. Particularly, forming the end 25*a* of the metal core 25 in the concave curved face like this embodiment relaxes concentration of stress, whereby the metal core 25 having an excellent durability can be produced.

Further, because the metal core is not prevented from rotating by a structure including any hole and a projection fitted therewith, the following advantages are presented. The front end 31*c* of the first metal core push rod 31 which engages with the end 25*a* of the metal core 25 is hard to compress when the metal core 25 is pressed in. Even if the front end 31*c* is compressed accompanied by the pressing in, there is no fear that the projection may be compressed in the hole so that engagement with the hole may be intensified. Therefore, there is no fear that the metal core 25 and the first metal core push rod 31 may be connected to block the movement of the metal core holder 21.

The end 25*a* of the metal core 25 is formed in the concave curved face while the other end 25*b* is formed in a flat face. Thus, when accommodating the metal core 25 in the holding hole 21*a* in the metal core holder 21, the direction of the metal core accommodated is easy to grasp thereby preventing accommodation error.

The manufacturing method and the manufacturing apparatus 11A according to a second embodiment of the present invention will be described with reference to FIGS. 13 to 18. In FIGS. 13 to 18, like reference numbers are attached to the same components as in FIGS. 1A to 12 and detailed description thereof is omitted.

Figure 13:
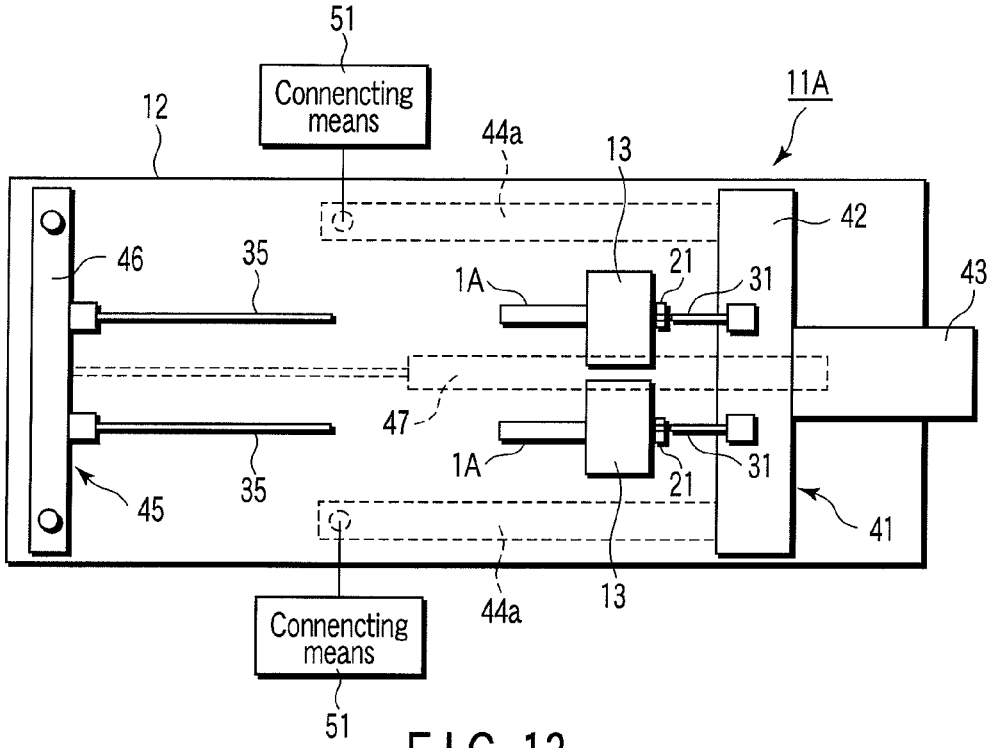
FIG. 13 is a conceptual plan view showing a manufacturing apparatus for carrying out a manufacturing method according to a second embodiment of the present invention in the waiting condition of FIG. 2.
Figure 14:
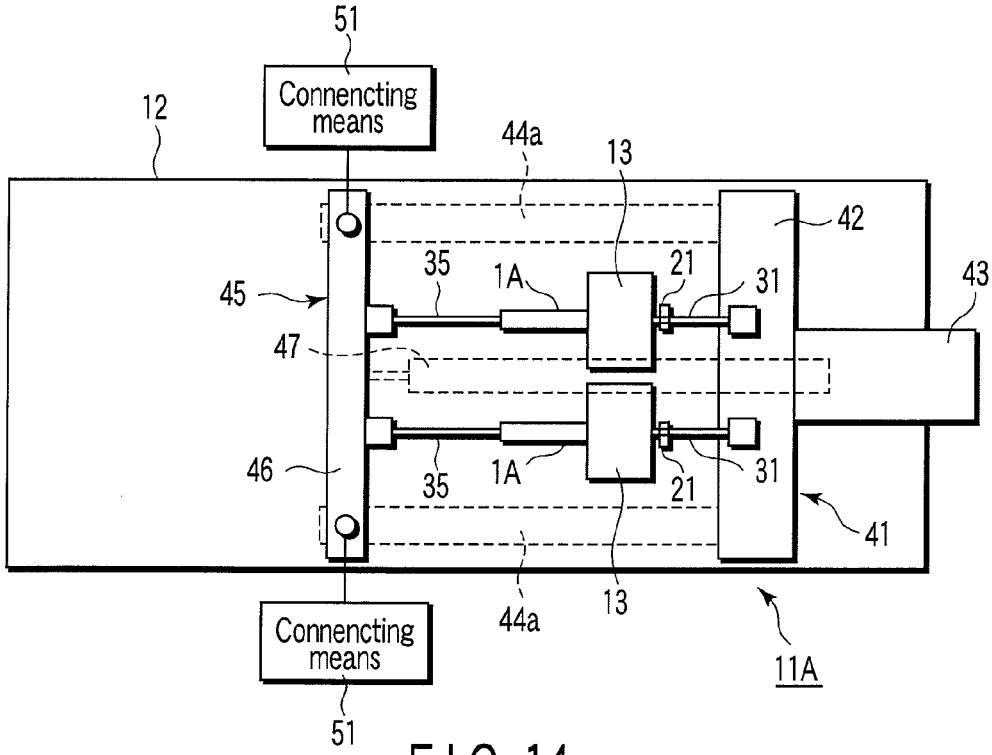
FIG. 14 is a conceptual plan view showing the manufacturing apparatus with the metal core being transferred as shown in FIG. 3.

In the second embodiment, at least one die assembly 13, for example plural die assemblies 13 are used, and more specifically, two of them are used as shown in FIGS. 13 and 14. These die assemblies 13 are arranged parallel on the base 12. The die assembly 13 includes the upper die 14 and the lower die 15 as shown in FIGS. 5 to 8 and has a die clamping mechanism (not shown). The lower die 15 is fixed and has the set groove 15*a* provided in its top face. The upper die 14 is closed or opened to the lower die 15 by the die clamping mechanism.

Figure 15:
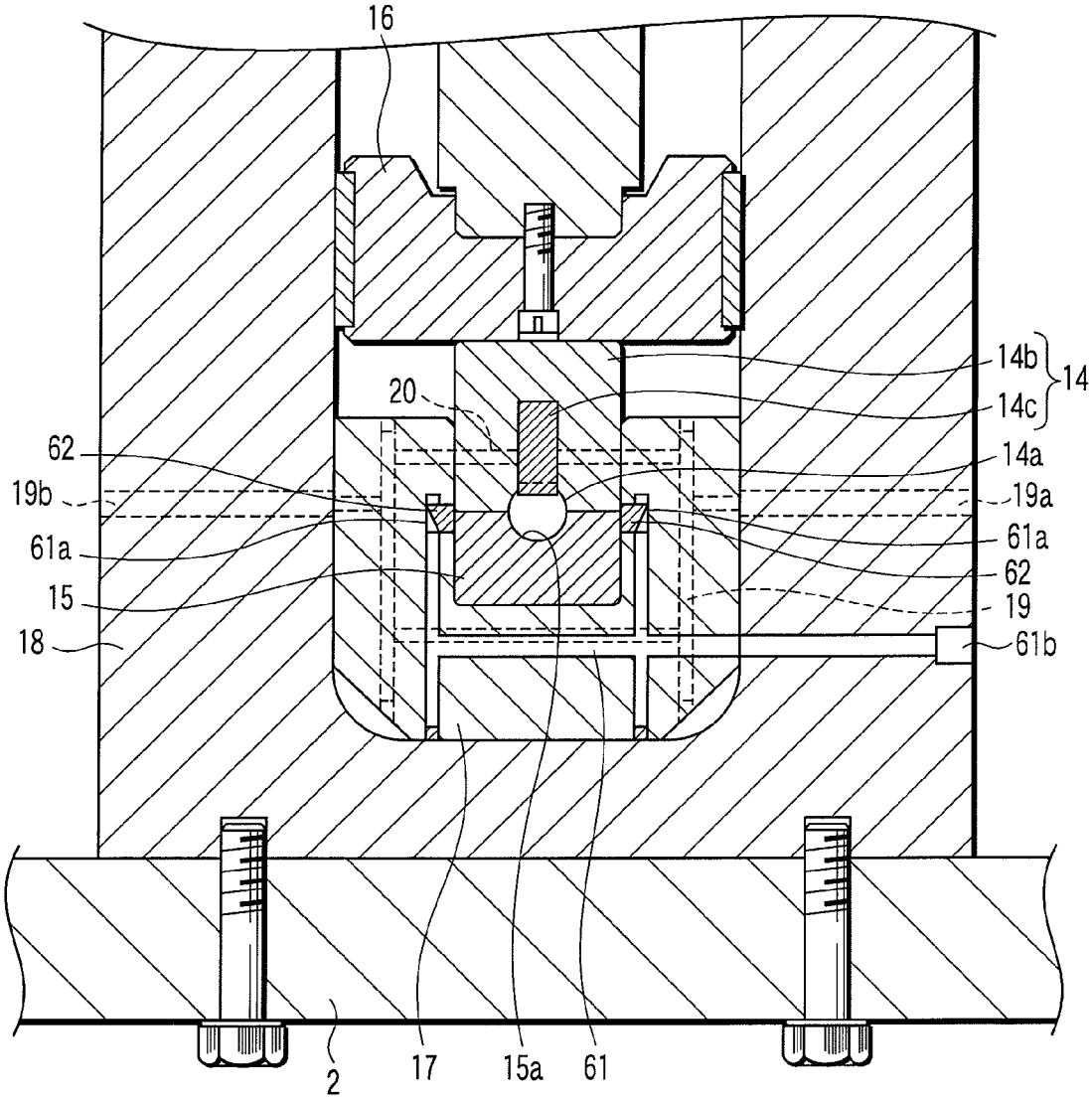
FIG. 15 is a sectional view showing part of the dies provided in the manufacturing apparatus with the dies clamped.
Figure 16:
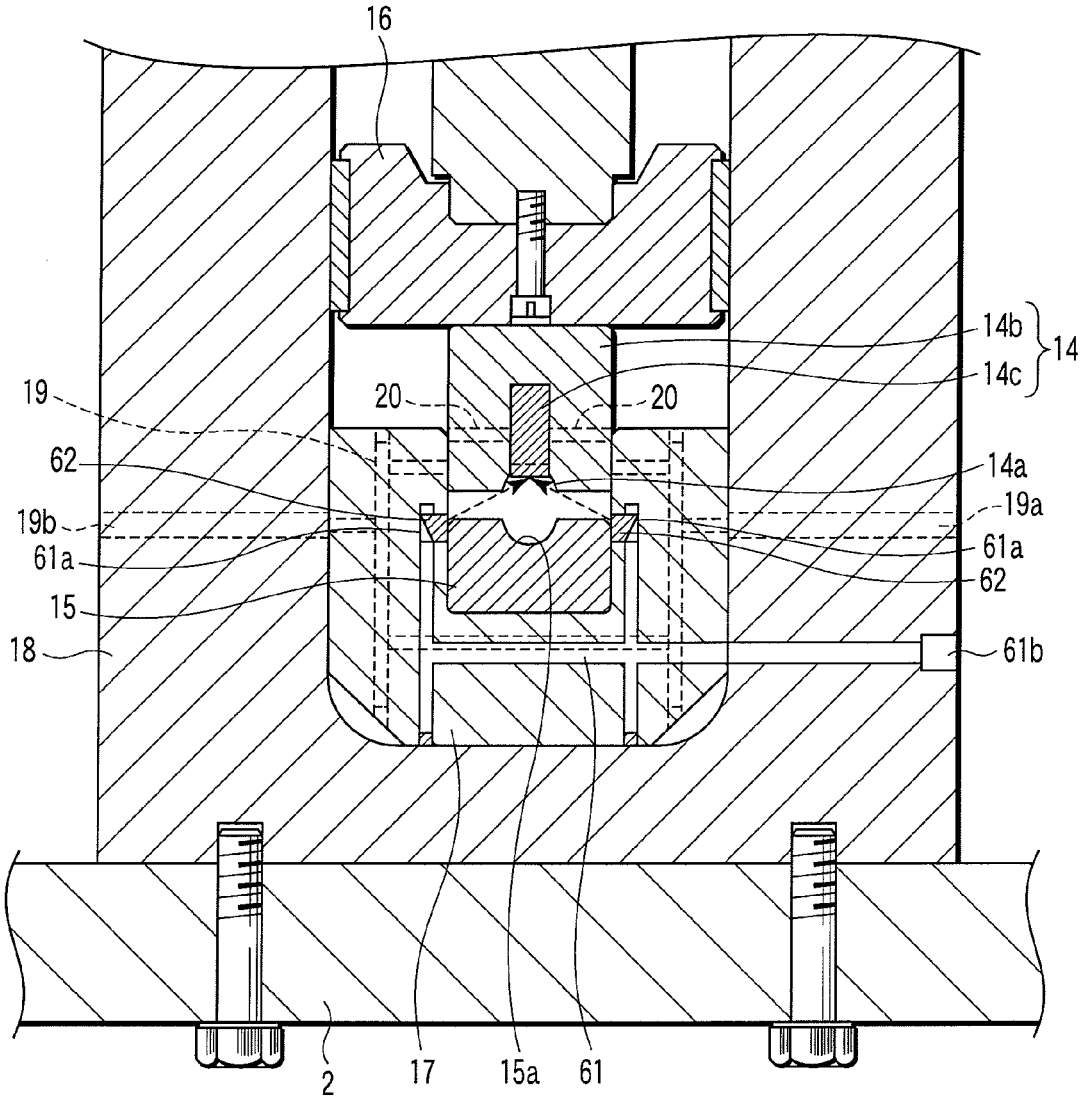
FIG. 16 is a sectional view showing part of the dies with the dies opened.

FIGS. 15 and 16 are sectional views of the periphery of the die assembly and reference number 16 in the same Figure indicates an upper die holder which moves up/down, reference number 17 indicates a lower die holder and reference number 18 indicates a holder supporting frame fixed to the base 12. The holder supporting frame supports the lower die holder 17. The lower die 15 is fixed to the bottom portion of a groove formed in the lower die holder 17 such that it is open upward. The upper die 14 fixed to the upper die holder 16 slides on the side face of the groove in the lower die holder 17 so as to approach/leave the lower die 15.

A cooling passage 19 is formed in the lower die holder 17 and the holder supporting frame 18. Other portions of the cooling passage 19 than an intake 19*a* and an outlet 19*b* are formed in the lower die holder 17, surrounding the lower die 15. A cooling passage 20 for introducing coolant to the side face of the tooth die 14*c* is formed in an upper die base 14*b*. When the dies are clamped as shown in FIG. 15, this cooling passage 20 communicates with the cooling passage 19 and when the dies are opened, is separated from the cooling passage 19 as shown in FIG. 16. The communicating portion of the cooling passage 19 to be connected to the cooling passage 20 is closed by the side face of the upper die base 14*b* when the dies are opened.

Preferably, a coolant circulating device (not shown) having a liquid cooling device is connected to the intake 19*a* and the outlet 19*b* of the cooling passage 19. The operation of this circulating device is continued during an operation of the manufacturing apparatus 11A so as to feed coolant to the cooling passages 19, 20. By this circulation, heat of the lower die 15 is discharged to the lower die holder 17, which is to be cooled by coolant regardless of generation of heat accompanied by the processing of the tooth die described later, thereby suppressing a rise of temperature of the lower die 15. As a result, heat of the upper die base 14*b* and the tooth die 14*c* is discharged to the lower die holder 17 and the like, thereby preventing a rise of temperature of the upper die 14.

By circulating coolant through the die assembly 13 forcibly, the rise of the temperature of the lower die 15 and the upper die 14 having the tooth die 14*c* is suppressed, whereby thermal expansion of these members is prevented from affecting formation of the engagement portion 4. Thus, this is preferable for forming the engagement portion 4 with high accuracy.

As shown in FIGS. 15 and 16, an oil passage 61 is provided in the lower die holder 17 and the holder supporting frame 18. The oil passage 61 has a pair of nozzle arrangement portions 61*a*. These nozzle arrangement portions 61*a* are provided so as to sandwich the die assembly 13 in the width direction and extend substantially parallel to the set grooves 14*a*, 15*a*. The nozzle arrangement portions 61*a* are open to the side faces of the upper die 14 and the lower die 15 which are matched when the die assembly 13 is clamped.

Figure 17:
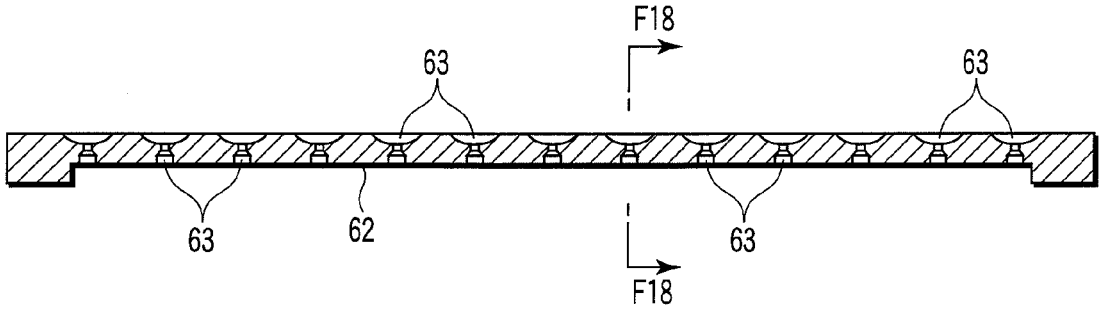
FIG. 17 is a sectional view showing an injection nozzle incorporated in the same dies.
Figure 18:
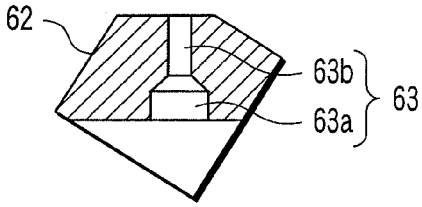
FIG. 18 is a sectional view taken along the line F18-F18 in FIG. 17 showing the injection nozzle.

The nozzle arrangement portion 61*a* is equipped with an injection nozzle 62 for spraying hydraulic oil to the entire tooth die 14*c*. The injection nozzle 62 has substantially the same length as the tooth die 14*c*. As shown in FIG. 17, the injection nozzle 62 has injection holes 63 at every specified interval in the length direction. As shown in FIG. 18, each injection hole 63 is formed of an intake hole portion 63*a* and an outlet hole portion 63*b* connected directly therewith. The intake hole portion 63*a* communicates with the oil passage 61. The outlet hole portion 63*b* is formed into a substantially semi-circular slit in order to spray hydraulic oil passing here widely in the length direction of the injection nozzle 62.

When the die assembly 13 is opened, hydraulic oil is injected toward the tooth die 14*c* of the upper die 14 positioned above and apart from the lower die 15 obliquely upward through each outlet hole portion 63*b*. Preferably, a corner defined by both side faces of the lower die 15 and the top face is chamfered (see FIG. 16) in order to prevent the corners from interfering with this injection. As a result, a distance between the injection nozzle 62 and the tooth die 14*c* when the die assembly is opened is shortened, so as to spray injected hydraulic oil against the tooth die 14*c* with a strong pressure.

An oil supply unit (not shown) is connected to the intake 61*b* of the oil passage 61. Each time the die assembly 13 is opened, this oil supply unit preferably operates to feed hydraulic oil by a predetermined quantity with pressure. In the meantime, the pressure feeding operation of hydraulic oil can be executed each time of plural die assembly openings determined preliminarily. Hydraulic oil injected obliquely upward from the injection nozzle 62 as indicated with dotted line in FIG. 16 is sprayed against the tooth die 14*c* by the operation of the oil supply unit so as to clean and cool this tooth die 14*c*.

Because the injected hydraulic oil is discharged out of the die assembly 13 through the set groove 15*a* in the lower die 15, the lower die 15 is cooled. Cooling of the tooth die 14*c* is preferable for improvement in formation accuracy of the engagement portion 4 as described previously.

Cleaning of the tooth die 14*c* has the following advantages. That is, part of a film generated by the above-mentioned bonderizing on the outside face of the steel pipe 1A sometimes might be attached to the tooth die 14*c* as refuse accompanied by formation of the engagement portion 4. If the engagement portion 4 is formed with foreign matter such as cutting powder which can exist at a place where the manufacturing apparatus 11A is installed attached to the outside face of the processing wall portion 5 of the steel pipe 1A held by the die assembly 13, it is considered that the foreign matter may be attached to the tooth die 14*c*.

If any refuse of the film or foreign matter is attached to the tooth die 14*c*, when the engagement portion 4 is formed in the steel pipe 1A held by the die assembly 13, the refuse or foreign matter sometimes might be transferred to the engagement portion 4. However, because the refuse of the film and foreign matter attached to the tooth die 14*c* are removed by cleaning the tooth die 14*c* with hydraulic oil as described above, a fear that formation failure may occur accompanied by the transfer can be avoided. In the meantime, although automatic cleaning of the tooth die 14*c* can be performed even if the tooth die 14*c* is directed upward, it is preferable to use the die assembly 13 in which the tooth die 14*c* is installed to be directed downward like this embodiment or directed laterally in order to obtain a sufficient reliability of cleaning.

The metal core holder 21 is disposed on one side of each die assembly 13, for example, on the right side of the die assembly 13 in FIGS. 2 to 8. As shown in FIGS. 5 to 8, the metal core holder 21 has a plurality of the holding holes 21*a*. These holding holes 21*a* penetrate the metal core holder 21 in the direction in which the set grooves 14*a*, 15*a* extend and the metal core 25 is accommodated in each holding hole. The metal core 25 supported by the metal core holder 21 is positioned on a side in which the first metal core push rod 31 is inserted into/removed from the die assembly 13.

The metal core holder 21 is moved by a holder driving portion (not shown). Each time this driving is implemented, one of the plural holding holes 21*a* is selected successively and brought to oppose an end of a hole defined by the set grooves 14*a*, 15*a*, which are matched. Thus, the metal core 25 supported by the metal core holder 21 can be taken into/out of the steel pipe 1A successively. To this end, according to this embodiment, the metal core holder 21 is moved by a specified pitch in a up-down direction (vertical direction) in FIGS. 5 to 8 by the holder driving portion. However, it may be moved in a lateral direction (in the front-rear direction of this paper in FIGS. 5 to 8). Alternatively, it is permissible to provide the metal core holder 21 rotatably and rotate it every specified angle by the holder driving portion.

Figure 11C:
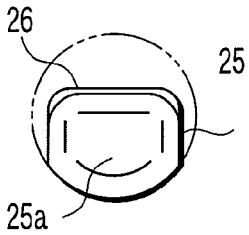
FIG. 11C is a front view showing a rotation stop face of the metal core.

The metal core 25 is formed of metal. The metal core 25 is subjected to treatment for increasing the hardness and abrasion resistance compared with the steel pipe 1A. The length of the metal core 25 is shorter than half the length of the tooth portion of the tooth die 14*c* indicated with reference symbol L in FIG. 5. As shown in FIG. 11C, the shape of the metal core 25 as seen from its end face is composed of a circular bottom face along the inner periphery of the steel pipe 1A, a pair of substantially parallel straight side faces continuous upward from both ends of this bottom face and a top face connecting the top ends of these side faces.

The manufacturing apparatus 11A having the above-described structure can obtain the same effect by manufacturing the hollow rack 1 like the manufacturing apparatus 11 described previously.

The moving base 42 supporting the first metal core push rod 31 is pushed or pulled directly by the driving portion 43 disposed on an opposite side of the die assembly 13 with respect to this moving base 42. Thus, loss of a force for pressing the metal core 25 into the steel pipe 1A by the first metal core push rod 31 can be suppressed when the metal core 25 is pressed in. In the meantime, if there exists any relay member between the first metal core push rod 31 and the moving base 42, the loss of the aforementioned force is generated easily due to deformation of the relay member.

In the manufacturing apparatus 11A as described above, the first connecting member 44 and the second connecting member 48 are connected and the first metal core push rod 31 and the second metal core push rod 35 are interlocked and moved in the same direction by the single push rod driving means 41 so as to reciprocate the metal core 25 sandwiched therebetween. Because the push rod driving means 41 which moves the first metal core push rod 31 and the second metal core push rod 35 to press the metal core 25 into the steel pipe 1A and reciprocate the metal core therein is used commonly, a push rod driving means is not needed for each of the first metal core push rod 31 and the second metal core push rod 35.

Because the single push rod driving means 41 is disposed on only one side of the die assembly 13, the dimension relative to the length of the base 12 is reduced. Further, because the driving portion 47 composed of an air cylinder is disposed so as to pull the second metal core push rod 35 toward the die assembly 13, the driving portion 47 is not a factor for increasing the length of the manufacturing apparatus 11A. Thus, not only can the manufacturing apparatus 11A be made small but also the installation space of the manufacturing apparatus 11A which takes into account the moving dimensions of both the push rods 31, 35 can be reduced.

By using the push rod driving means 41 commonly, the structure of the manufacturing apparatus 11A can be simplified. Further, because the metal core 25 is moved by interlocking the first metal core push rod 31 and the second metal core push rod 35, there is no fear that the operation timing of the first metal core push rod 31 and the second metal core push rod 35 is messed up.

Because the driving portion 47 which moves the second metal core push rod 35 toward the metal core holder 21 in order to sandwich the metal core 25 has no driving force large enough to press the second metal core push rod 35 into the steel pipe 1A, configuration of the apparatus can be simplified and inexpensive.

The driving portion 43 of the single push rod driving means 41 provided in the manufacturing apparatus 11A has a servo motor 43*b* as its driving source. Because the operating condition of the servo motor 43*b* can be monitored, the moving speed of the metal core 25 can be adjusted depending on processing condition by adjusting the rotation speed of the servo motor 43*b* electrically.

That is, in a period in which the engagement portion 4 is formed with the metal core 25 making a firm contact with the inside face of the processing wall portion 5 of the steel pipe 1A (tooth formation period), the moving speed of the metal core 25 can be retarded and in other periods, that is, a period in which the metal core 25 is transferred from the metal core holder 21 to the steel pipe 1A, the moving speed of the metal core 25 can be increased. More specifically, the moving speed of the metal core 25 in the tooth formation period can be set to 150 mm/sec to 350 mm/sec and the moving speed of the metal core 25 in other periods can be set to 200 mm/sec to 400 mm/sec.

Productivity can be improved by thus adjusting the moving speed. Further, because the metal core 25 is blocked from being carried to its pressing in state at an excessive speed, the metal core 25 is protected from a damage thereby securing a long service life thereof.

Because the driving portion 43 has the servo motor 43*b*, stroke control, load control and position control are facilitated as well as existing processing speed control. Under the stroke control, the stroke of the metal core 25 is changed depending on the position and length of the processing wall portion 5 of the steel pipe 1A. Under the load control, a force of pressing in the metal core 25 is controlled depending on the metal composition of the steel pipe 1A and the structure of the rack. Under the position control, the moving position of the metal core 25 under the existing processing speed control is recognized.

By adopting the servo motor 43*b* as a driving source for the driving portion 43, noise and rise in temperature when the push rod driving means 41 is operated can be suppressed. Further, there is no possibility of oil leakage as compared with adopting a hydraulic cylinder as the driving source for the driving portion 43. Therefore, working environment of the installation place of the manufacturing apparatus 11A can be improved.

Figure 19:
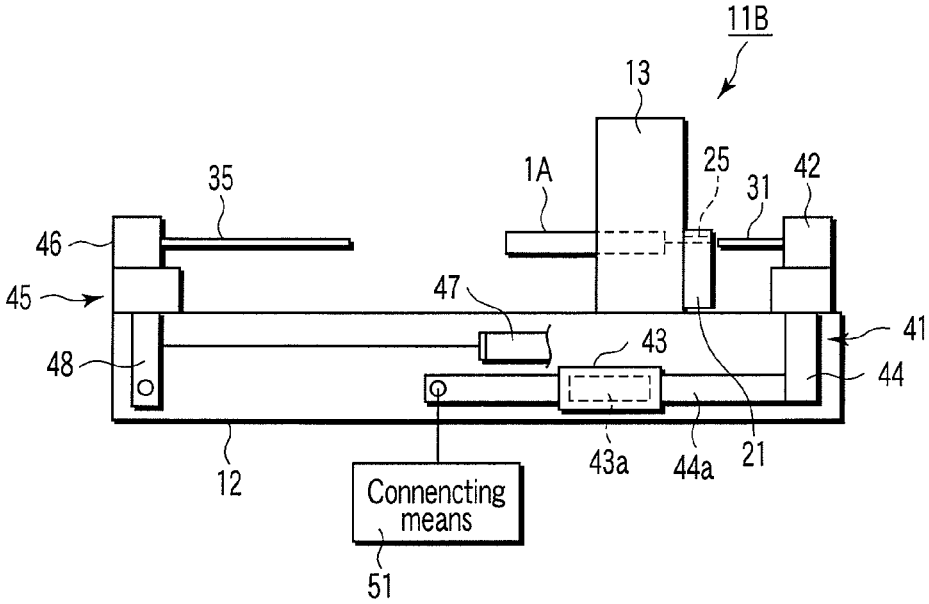
FIG. 19 is a conceptual front view of a manufacturing apparatus for carrying out a manufacturing method according to a third embodiment of the present invention.

FIG. 19 is a diagram showing the manufacturing method and manufacturing apparatus 11B according to a third embodiment of the present invention. The third embodiment is the same as the second embodiment including composition not shown in FIG. 19 except matters described below. The same reference numbers as the second embodiment are attached to the same components as the second embodiment and description thereof is omitted.

According to the third embodiment, the driving portion 43 of the push rod driving means 41 is positioned between a pair of the moving bases 42 and 46 and fixed within the base 12 such that it is positioned below the die assembly 13 and within a length of the first connecting member 44. If speaking in detail, the driving portion 43 is disposed within the base 12 so that it is positioned forward or backward of the first connecting member 44 when the base 12 is viewed in the back and forth direction and projected onto the first connecting member 44. The "back and forth direction" mentioned here indicates the front face to rear face direction of the paper representing FIG. 19 and in other words, it is a direction of viewing the manufacturing apparatus 11B from the front face or conversely a direction of viewing the manufacturing apparatus 11B from the rear face. More preferably, the driving portion 43 is disposed such that it is projected onto the front end portion 44*a* of the first connecting member 44. This driving portion 43 moves the moving base 42 in a direction of approaching/leaving the die assembly 13 via the first connecting member 44. Instead of disposing the driving portion 43 such that it is projected onto the first connecting member 44 when the manufacturing apparatus 11B is viewed in the back and forth direction, the driving portion 43 may be disposed such that it is projected onto the first connecting member 44 when the manufacturing apparatus 11B is viewed in up/down direction.

The third embodiment is the same as the second embodiment except the above described matter. Therefore, the third embodiment can solve the problem of the present invention for the reasons described already in the second embodiment. Additionally, the following advantages can be mentioned.

By disposing the driving portion 43 of the push rod driving means 41 as described previously, the base 12 does not need a portion for disposing the driving portion 43 on an opposite side to the die assembly 13 with respect to the moving base 42. Thus, the dimension relative to the length of the base 12 is further reduced thereby further reducing the size of the manufacturing apparatus 11B.

According to the both embodiments, the metal core 25 is sandwiched by the first metal core push rod 31 and the second metal core push rod 35 when the metal core 25 is reciprocated as described above, thereby blocking the metal core from rotating. Thus, it is permissible to omit the means adopted by the both embodiments, that is, the structure which engages the first metal core push rod 31 with the metal core 25 in the concave-convex configuration relationship in order to secure the stoppage of the rotation of the metal core 25.

A manufacturing method and manufacturing apparatus 111 according to a fourth embodiment of the present invention will be described with reference to FIGS. 20A to 27.

Figure 20A:
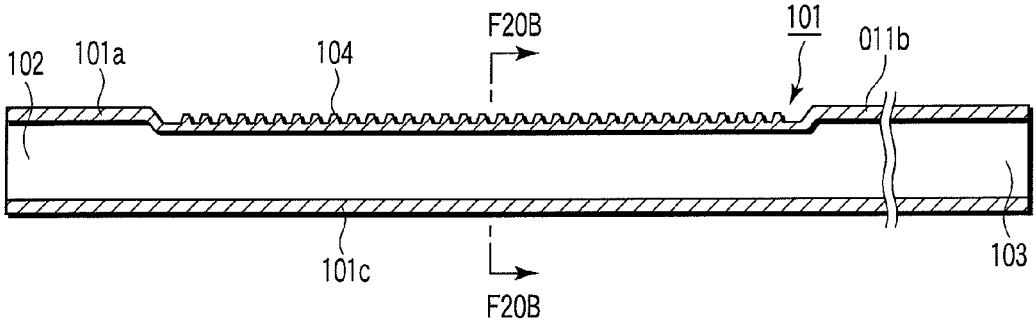
FIG. 20A is a sectional view showing a hollow rack manufactured by a manufacturing apparatus for carrying out a manufacturing method according to a fourth embodiment of the present invention.
Figure 20B:
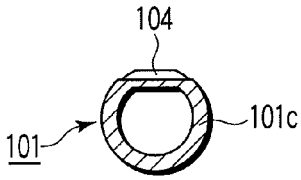
FIG. 20B is a sectional view taken along the line F20B-F20B in FIG. 20A showing the hollow rack.

Reference number 101 in FIGS. 20A and 20B indicates a hollow rack (hereinafter simply "rack") for use as a hollow steering rack of an automotive power steering unit. This rack 101 is a semi-completed product processed by the manufacturing apparatus 111 described later and subjected to necessary post processing on a next process.

The rack 101 is open at both ends in the direction of extension of its axis (hereinafter referred to as axial direction). An opening at an end of the rack 101 is indicated with reference number 102 and an opening at the other end is indicated with reference number 103. A rack 104 is formed in the outer face of a portion near the opening 102 at the end of the rack 101. This rack 104 is constructed by arranging the plural rack teeth. Portions 101*a*, 101*b* off the rack 104 in the axial direction of the rack 101 have a cylindrical section. A portion 101*c* provided with the rack 104 in the axial direction of the rack 101 has a non-cylindrical section as shown in FIG. 20B.

Figure 21:
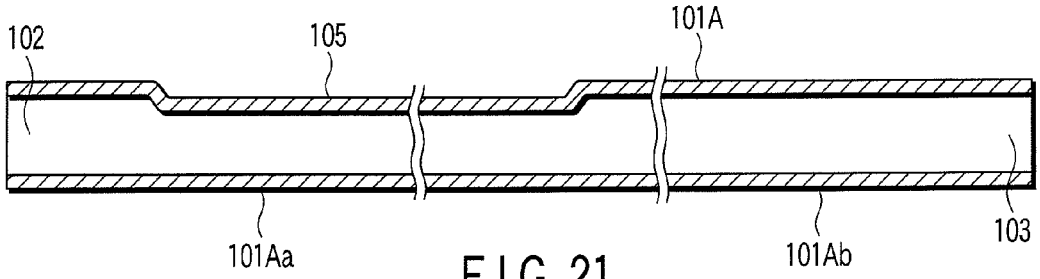
FIG. 21 is a sectional view showing a steel pipe before it is manufactured as the hollow rack.

The rack 101 is manufactured by processing a metallic hollow material, for example, straight steel pipe 101A shown in FIG. 21 with the manufacturing apparatus shown in FIGS. 22 to 27. Both ends in the axial direction of the steel pipe 101A are open and an opening at an end is the same as the opening 102 at one end of the rack 101 while an opening at the other end of the steel pipe 101A is the same as the opening 103 at the other end of the rack 101.

A processing wall portion 105 is formed in a portion 101Aa near an end portion of the steel pipe 101A. The rack 104 is formed in the outer face of the processing wall portion 105. The processing wall portion 105 is provided by compressing part of a pipe wall near the opening 102 at the end of the steel pipe 101A into a flat surface by pressing in an inward direction of the steel pipe 101A.

The hollow rack manufacturing apparatus 111 shown in FIGS. 22 to 27 includes a die assembly 113, a metal core holder 121, a plurality of metal cores 125, a first metal core push rod 131, a second metal core push rod 135, a separating mechanism 141, a setting mechanism 151 and the like.

The die assembly 113 includes an upper die 114 and a lower die 115 and contains a die clamping mechanism (not shown). The lower die 115 is fixed and has a set groove 115*a* (see FIGS. 25 to 27) provided in the top face thereof. The upper die 114 is opened or closed to the lower die 115 by the die clamping mechanism.

Figure 22:
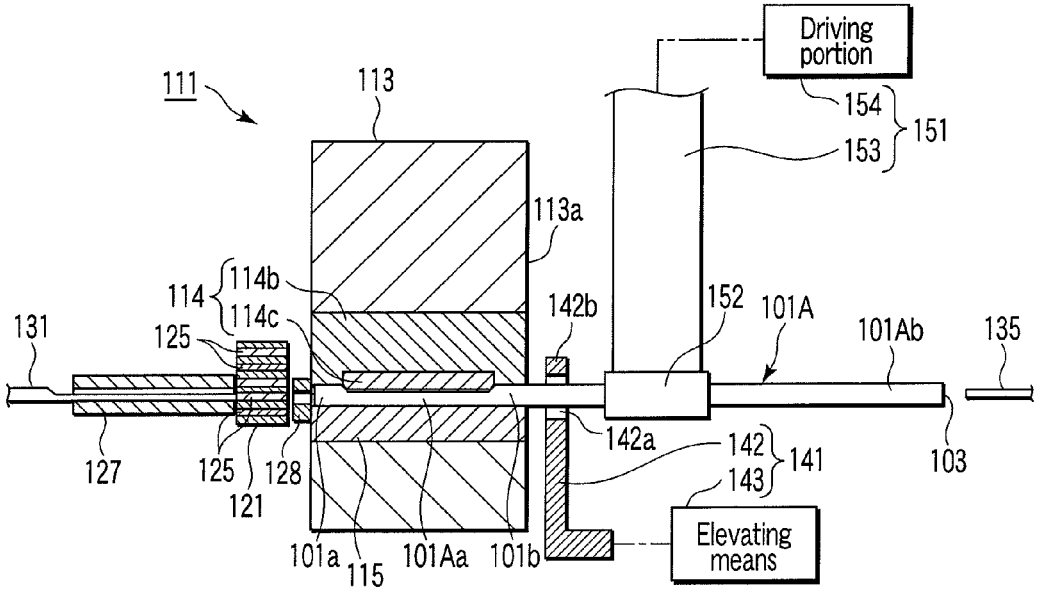
FIG. 22 is a sectional view showing an example of the manufacturing apparatus with the dies clamped.

The upper die 114 is configured so that a tooth die 114*c* is mounted detachably to an upper die base 114*b*. The upper die base 114*b* has a set groove 114*a* (see FIGS. 25 to 27) provided in the bottom face thereof. Bottom ends of the tooth die 114*c* project between both ends in the length direction of the set groove 114*a*. Downward directed tooth portion having unevenness is formed in the bottom end portion of the tooth die 114*c*. When the dies are clamped as shown in FIG. 22, the set grooves 114*a*, 115*a* are matched so as to sandwich the steel pipe 101A from up and down. In this case, the portion 101Aa near an end of the steel pipe 101A provided with the processing wall portion 105 is sandwiched by the upper die 114 and the lower die 115 and most of the portion at the other end of the steel pipe 101A longer than the processing wall portion 105 (the portion 101*b* is included in this portion and the portion at the other end is called projecting portion 101Ab) is projected horizontally sideways of the die assembly 113.

The metal core holder 121 is disposed on one side of the die assembly 113, for example, only on the left side of the die assembly 113 in FIGS. 22 to 27. The metal core holder 121 has a plurality of holding holes. These holding holes penetrate the metal core holder 121 in the direction in which the set grooves 114*a*, 115*a* extend and the metal core 125 is accommodated therein. Each metal core 125 supported by the metal core holder 121 is positioned on a side in which the first metal core push rod 131 is inserted into/removed from the die assembly 113.

The metal core holder 121 is moved by a holder driving portion (not shown). Each time this drive is performed, one of the plural holding holes is selected successively and placed to oppose an end of a hole formed by the set grooves 114*a*, 115*a* matched with each other. Thus, the metal core 125 supported by the metal core holder 121 can be inserted into/removed from the steel pipe 101A successively. To this end, according to this embodiment, the metal core holder 121 is moved by the holder driving portion every constant pitch vertically (in a vertical direction) in FIGS. 22 to 27. However, it may be moved sideways (in the front face to rear face direction of paper in FIGS. 22 to 27). Alternatively, it is permissible to provide the metal core holder 121 rotatably and rotate it every predetermined angle by the holder driving portion.

Each metal core 125 is formed of metal. The metal core 125 is subjected to processing of increasing its hardness and abrasion resistance as compared with the steel pipe 101A. The length of the metal core 125 is smaller than half the length of the processing wall portion 105, in other words, the length of the tooth portion of the tooth die 114*c*.

Although not shown, the metal core 125 has a plurality of convex portions arranged in the length direction thereof. These convex portions have tapered faces on both sides of each of their apexes. The heights of the convex portions of the metal core 125 accommodated in the metal core holder 121 are different from each other. Taking of the metal core 125 into/out of the metal core holder 121 upon processing is carried out successively in order from the metal core 125 having relatively low convex portions.

The first metal core push rod 131 is made of metal and has a proximal shaft portion and an insertion shaft portion. The insertion shaft portion is a portion which is inserted into/removed from the steel pipe 101A. This first metal core push rod 131 is pushed or pulled by push rod driving means (not shown) which is driven by a servo motor, for example. Consequently, the insertion shaft portion of the first metal core push rod 131 is inserted into/removed from the steel pipe 101A held by the die assembly 113. At that time, the insertion shaft portion is inserted into the steel pipe 101A held by the die assembly 113 accompanying the metal core 125 with which a front end thereof keeps contact.

The second metal core push rod 135 shown in FIG. 22 is made of metal and has a proximal shaft portion and an insertion shaft portion. The insertion shaft portion is a portion which is to be inserted into/removed from the steel pipe 101A held by the die assembly 113. This second metal core push rod 135 is reciprocated by a push rod moving body (not shown) composed of an air cylinder, for example. Consequently, the insertion shaft portion of the second metal core push rod 135 is taken into/out of the steel pipe 101A held by the die assembly 113 from an opposite side to the first metal core push rod 131. When the second metal core push rod 135 is extracted out of the die assembly 113 and placed at a predetermined standby position, space which allows the steel pipe 101A to be processed to be inserted into/removed from the die assembly 113 is secured between the second metal core push rod 135 and the die assembly 113, different from the state of FIG. 22.

Reference number 127 in FIGS. 22 to 27 shows a tubular push rod guide. The insertion shaft portion of the first metal core push rod 131 is introduced into the holding hole in the metal core holder 121 by this push rod guide 127. Reference number 128 in FIGS. 22 to 27 shows a metal core guide disposed between the metal core holder 121 and the die assembly 113. The metal core 125 and the insertion shaft portion of the first metal core push rod 131 are inserted into/removed from the steel pipe 101A held by the die assembly 113 through the hole in the metal core guide 128. The insertion shaft portion of the second metal core push rod 135 can be inserted through the hole in the metal core guide 128.

The separating mechanism 141 is for separating the steel pipe 101A in which the rack 104 is formed from the tooth die 114*c* of the upper die 114 and is provided outside of the die assembly 113. The separating mechanism 141 shown in FIGS. 22 to 27 has a separating member 142 and elevating means 143.

The separating member 142 is elevatably disposed on a side in which the second metal core push rod 135 is to be inserted into/removed from the die assembly 113, near the die assembly 113, in other words, on a side in which the steel pipe 101A is projected from the die assembly 113. This separating member 142 has a through portion 142*a*. The through portion 142*a* is formed of a circular hole having a larger diameter than the hole in the die assembly 113 constituted of the set grooves 114*a*, 115*a* matched with each other. The steel pipe 101A having a smaller diameter than the through portion 142*a* is passed through the through portion 142*a* with a play. In the meantime, the shape of the through portion 142*a* is not limited to any circular shape but may be of a hole having a C-shaped cutout as seen in its side view.

The elevating means 143 elevates the separating member 142. A servo motor can be used preferably as the drive source of the elevating means 143. When the separating member 142 is lowered by this elevating means 143, the steel pipe 101A is separated downward from the tooth die 114*c* of the upper die 114.

The setting mechanism 151 inserts/removes the portion 101Aa in which the processing wall portion 105 is formed into/from the die assembly 103 by gripping the steel pipe 101A from sideways of the opened die assembly 113 and is provided on an opposite side to the die assembly 113 with respect to the separating member 142. This setting mechanism 151 includes a setting member 153 having a chuck 152 at its front end and a driving portion 154. The chuck 152 grips the steel pipe 101A detachably. The driving portion 154 for moving the setting member 153 uses a servo motor as its driving source. The chuck 152 is moved in a direction of approaching/leaving the die assembly 113 and in a vertical direction by the operation of the driving portion 154.

The procedure for forming the rack 104 on the steel pipe 101A with the hollow rack manufacturing apparatus 111 having the above-described structure will be described.

Figure 27:
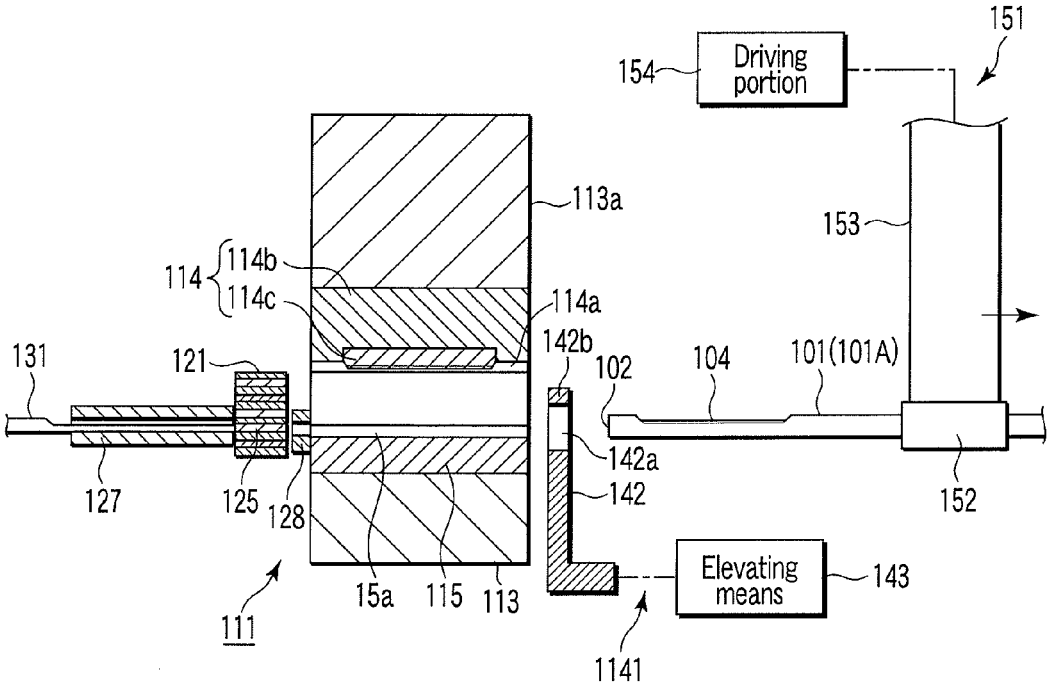
FIG. 27 is a sectional view showing an example of the manufacturing apparatus with the rack pulled out of the dies.

FIG. 27 shows a state in which the die assembly 113 is opened. With this state, the upper die 114 is disposed apart upward by a predetermined distance from the lower die 115. The separating member 142 of the separating mechanism 141 is disposed at a standby position by the elevating means 143 and the chuck 152 of the setting mechanism 151 is disposed at a standby position by the driving portion 154.

In this case, the separating member 142 disposed out of the die assembly 113 is held in a most lowered condition and the central portion of the through portion 142*a* opposes an end of the setting groove 115*a* in the lower die 115. FIG. 27 shows a state in which the steel pipe 101A formed into the rack 101 having the processed rack 104 is gripped by the chuck 152, and at a stage of starting manufacture, the steel pipe 101A is not held by the setting mechanism 151.

Next, after the driving portion 154 of the setting mechanism 151 is actuated so as to grip the steel pipe 101A in which the processing wall portion 105 is formed, this steel pipe 101A is inserted into the die assembly 113. In this case, first, an intermediate portion in the axial direction of the steel pipe 101A is gripped by the chuck 152 such that the processing wall portion 105 is directed upward. Then, with this gripping state, the portion 101Aa near an end portion of the steel pipe 101A having the processing wall portion 105 is directed to the side face 113*a* on one side of the die assembly 113 by an operation of the driving portion 154 and this portion 101Aa is disposed opposing the central portion of the through portion 142*a*. Further, the chuck 152 is moved by a predetermined distance by the operation of the driving portion 154 so as to approach the side face 113*a* of the die assembly 113. Consequently, the portion 101Aa of the steel pipe 101A is passed through the through portion 142*a* and then set within the setting groove 115*a* in the lower die 115.

In this state, with the opening 102 at an end of the steel pipe 101A opposing the metal core guide 128 at a near distance, the entire processing wall portion 105 is accommodated within the die assembly 113 and a projecting portion 101Ab of the steel pipe 101A is projected from the side face 113*a* of the die assembly 113. The state in which the portion 101Aa near an end portion of the steel pipe 101A is inserted into the die assembly 113 is the same as FIG. 26. In the meantime, although the rack 101 having the processed rack 104 is drawn in FIG. 26 for convenience for explanation, the rack 104 has not been processed in the steel pipe 101A at this setting stage.

After this, the die assembly 113 is clamped. Consequently, as shown in FIG. 22, the portions 101*a*, 101*b* on both sides of the processing wall portion 105 are sandwiched by the upper die 114 and the lower die 115 from up/down while the tooth die 114*c* makes contact with the outside face of the processing wall portion 105 from above.

By operating the metal core holder 121 before or after such a setting work, one of the plural metal cores 125 accommodated therein is held such that it opposes the through hole in the metal core guide 128.

Next, the second metal core push rod 135 is moved toward the die assembly 113 by the push rod moving body (not shown). Consequently, the second metal core push rod 135 is inserted into the steel pipe 101A through the opening 103 at the other end of the steel pipe 101A and the front end of the second metal core push rod 135 is inserted through the opening 102 at the end of the steel pipe 101A and the through hole in the metal core guide 128. Thus, the metal core 125 within the metal core holder 121 opposing the through hole is sandwiched by the first metal core push rod 131 and the second metal core push rod 135 from both ends in the axial direction.

The insertion shaft portion of the second metal core push rod 135 passed through the steel pipe 101A so as to meet the metal core 125 never makes contact with the inside face of the processing wall portion 105 in the above mentioned process and in other processes described later. Even if it makes contact, it is extremely slight. Therefore, the push rod moving body of the second metal core push rod 135 needs no driving force large enough to deform the processing wall portion 105.

With this state, the first connecting member (not shown) which is moved together with the first metal core push rod 131 and the second connecting member (not shown) which is moved together with the second metal core push rod 135 are connected by connecting means (not shown). Thus, the first metal core push rod 131 and the second metal core push rod 135 come into contact with both ends of the metal core 125 so as to maintain a state in which the metal core 125 is sandwiched therebetween.

Next, by operating the push rod driving means (not shown), the first metal core push rod 131 is inserted into/removed from the portion 101Aa near an end portion of the steel pipe 101A held by the die assembly 113 by reciprocating the first metal core push rod 131 so as to bring back the metal core 125 into the metal core holder 121.

If speaking in detail, the first metal core push rod 131 is inserted into the metal core holder 121 and the metal core guide 128 until it reaches a predetermined insertion depth from the opening 102 at one end of the steel pipe 101A held by the die assembly 113 and after that, brought back. At this time, the second metal core push rod 135 is moved interlockingly with the first metal core push rod 131.

When the second metal core push rod 135 is retreated synchronously with the insertion of the first metal core push rod 131 into the die assembly 113, the metal core 125 is pressed by the first metal core push rod 131 into the steel pipe 101A while it is sandwiched by the first metal core push rod 131 and the second metal core push rod 135. By this pressing in, the metal core 125 plastically fluidizes the flesh of the processing wall portion 105 of the steel pipe 101A so that it is pressed in from inside of the steel pipe 101A toward the tooth die 114*c* outside.

The second metal core push rod 135 is moved toward the metal core holder 121 synchronously when the first metal core push rod 131 is pulled back and then, the metal core 125 is pressed by the second metal core push rod 135 while it is sandwiched by the first metal core push rod 131 and the second metal core push rod 135, so that it passes through the opening 102 at the end of the steel pipe 101A and the metal core guide 128 and is pushed back into the metal core holder 121. In this case, the metal core 125 plastically fluidizes the flesh of the processing wall portion 105 of the steel pipe 101A so that it is pressed from inside of the steel pipe 101A toward the tooth die 114*c* outside.

After that, by moving the metal core holder 121, the metal core 125 having a next largest sectional area and a holding hole accommodating this are set to oppose the opening 102 at one end of the steel pipe 101A through the through hole in the metal core guide 128. In this case, connection of the first and second connecting members is released to release the state of the sandwiched metal core 125. Consequently, the metal core holder 121 can be moved reasonably without being disturbed by the first and second connecting members so as to select the metal core 125 for use next time.

After the metal core 125 for use next time is sandwiched by the first metal core push rod 131 and the second metal core push rod 135, the push rod driving means is operated again to reciprocate the metal core 125 for use next time once by the first metal core push rod 131 and the second metal core push rod 135 which are interlocked with each other. By repeating the procedure successively, the steel pipe 101A having the rack 104 corresponding to the tooth die 114*c* of the die assembly 113, that is, the rack 101, is manufactured.

Next, the rack 101 is taken out of the die assembly 113 as follows. First, after the metal core 125 used last is returned to the metal core holder 121, the second metal core push rod 135 is pulled out of the rack 101 and then, the die assembly 113 is opened.

Figure 23:
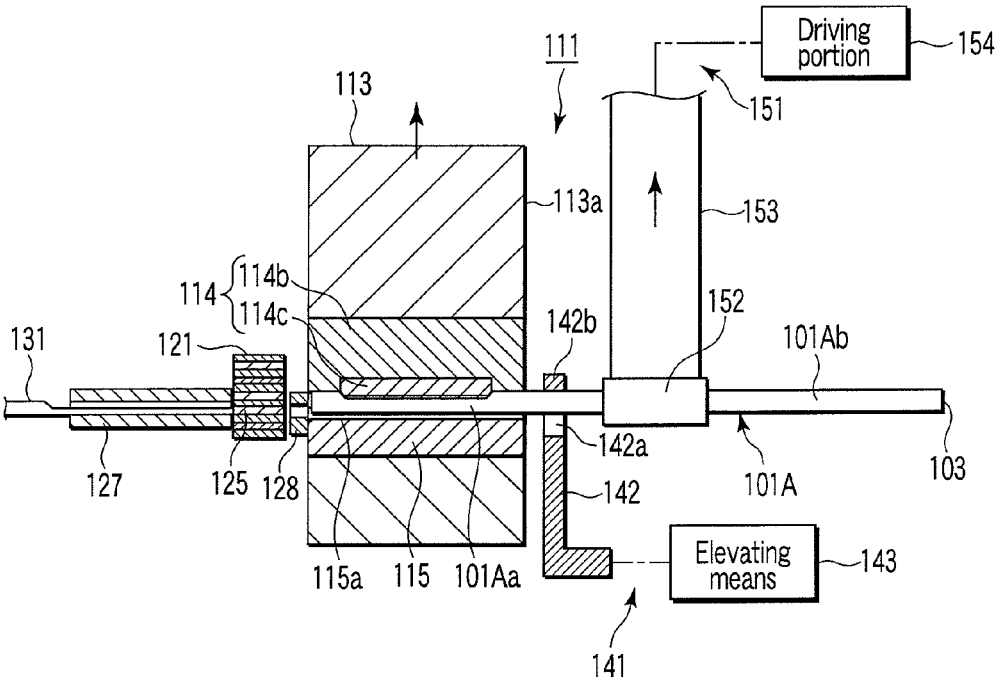
FIG. 23 is a sectional view showing an example of the manufacturing apparatus with opening of the dies started.

FIG. 23 shows a state in which the die assembly 113 has begun to open. In this state, with the rack 104 attached to the tooth die 114*c* of the upper die 114, the rack 101 begins to rise with the upper die 114. In this case, the driving portion 154 of the setting mechanism 151 is operated synchronously with opening of the die assembly 113, so that the chuck 152 gripping the rack 101 is raised. Accompanied by this, the elevating means 143 of the separating mechanism 141 is actuated synchronously with the opening of the die assembly 113 so that the separating member 142 is raised.

Figure 24:
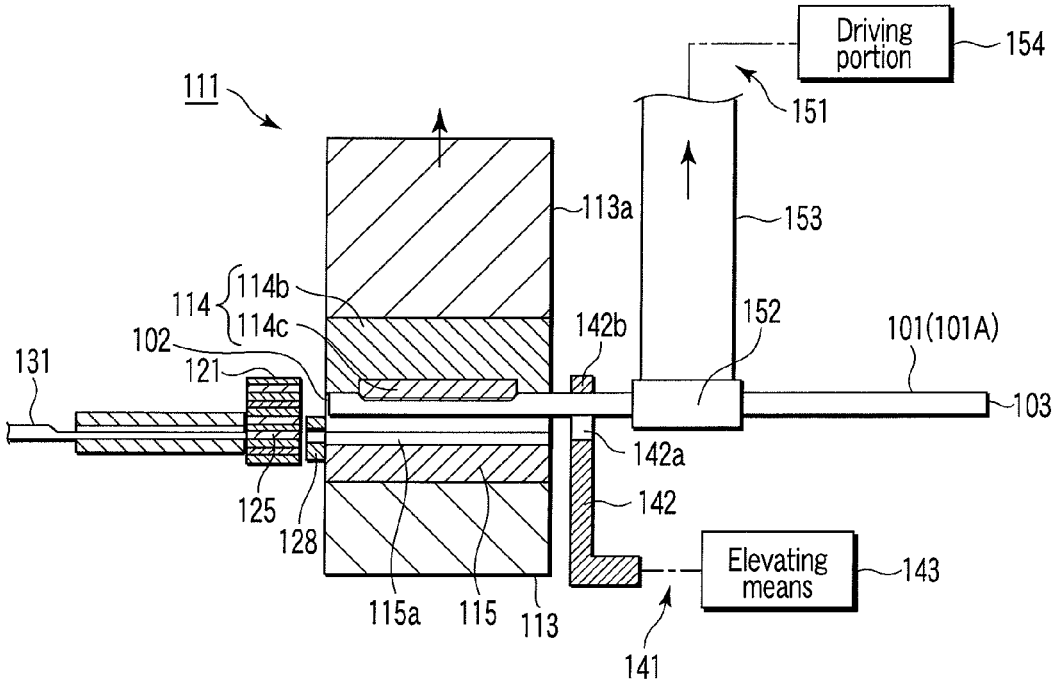
FIG. 24 is a sectional view showing an example of the manufacturing apparatus with opening of the dies completed.

When opening of the die assembly 113 is completed, the separating mechanism 141 and the setting mechanism 151 are held in a stop condition temporarily. With this state, as shown in FIG. 24, a pressing portion 142*b* which is composed of the top end portion of the separating member 142 disposed at a rise position maintains slight contact with the projecting portion 101Ab of the rack 101 with respect to the die assembly 113 from above or is positioned slightly apart therefrom.

Figure 25:
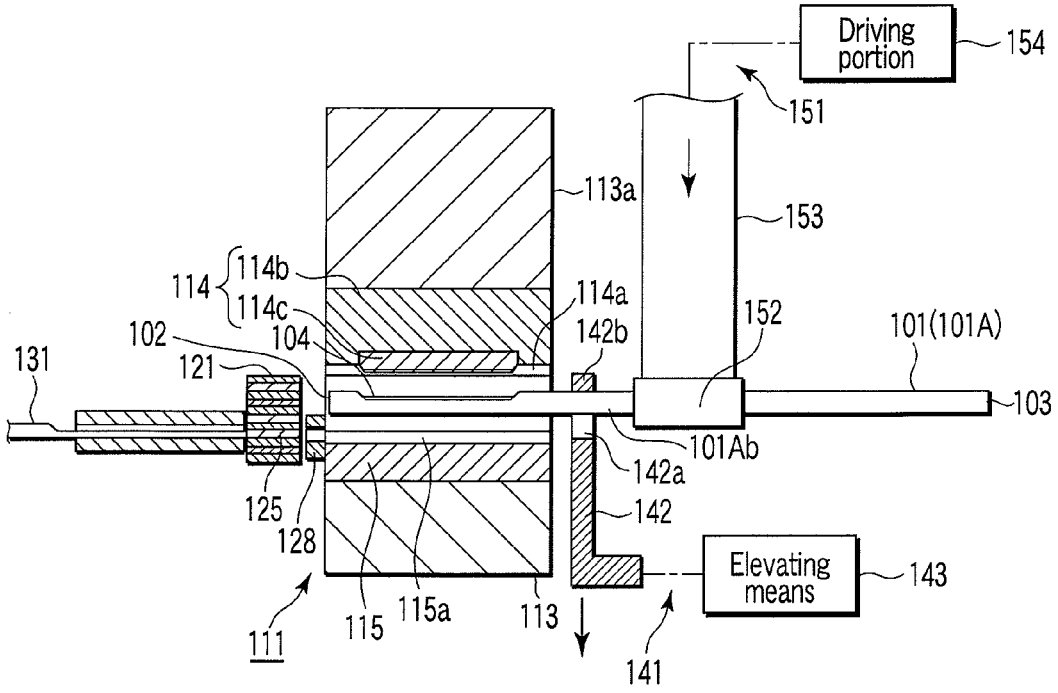
FIG. 25 is a sectional view showing an example of the manufacturing apparatus with releasing of the dies started.

After that, the separating mechanism 141 and the setting mechanism 151 are operated synchronously, and the chuck 152 is lowered together with the separating member 142. Consequently, the pressing portion 142*b* of the separating member 142 pulled down presses the projecting portion 101Ab downward from up and consequently, the portion 101Aa near the end portion of the rack 101 is separated from the tooth die 114*c*. FIG. 25 shows a separation state of the rack 101.

Figure 26:
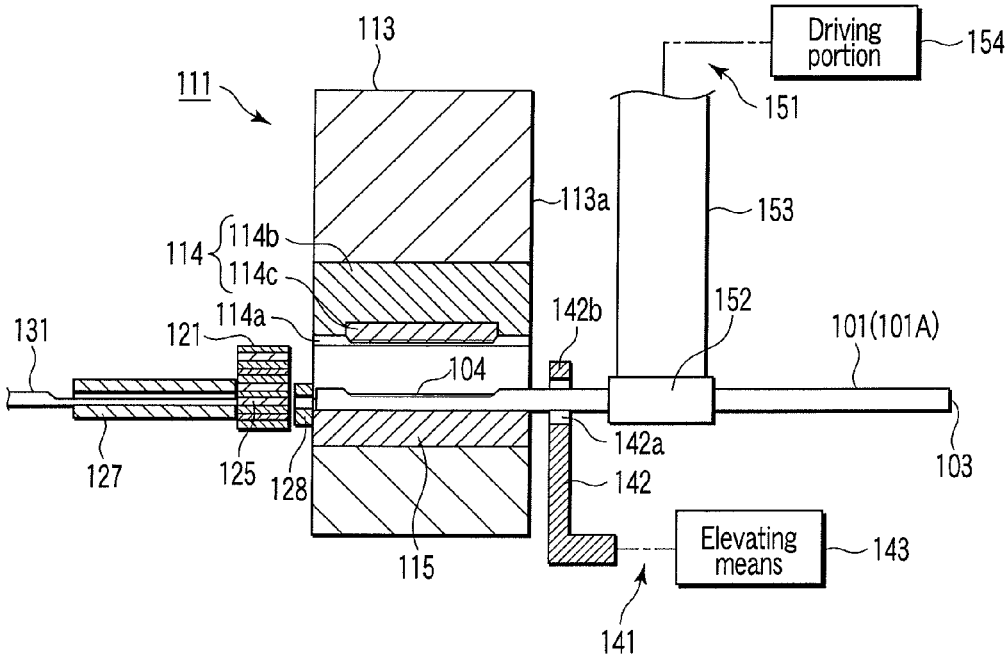
FIG. 26 is a sectional view showing an example of the manufacturing apparatus with releasing of the dies completed.

Subsequently, the separating member 142 is pulled down to the lowest position by the separating mechanism 141 as shown in FIG. 26. Consequently, the central portion of the through portion 142*a* of the separating member 142 and an end of the setting groove 115*a* in the lower die 115 oppose each other. At the same time, the chuck 152 gripping the rack 101 is lowered by the setting mechanism 151 up to a position where the portion 101Aa near the end portion of the rack 101 is disposed within the setting groove 115*a* of the lower die 115 as shown in FIG. 26.

Finally, the chuck 152 gripping the rack 101 is moved in a direction of departing from the side face 113*a* of the die assembly 113 by the driving portion 154 of the setting mechanism 151 as shown in FIG. 27. Consequently, the rack 101 is pulled from the die assembly 113 through the through portion 142*a* in the separating member 142 and the removal work for the rack 101 is completed. After this, the above-described operation is repeated.

In the manufacturing apparatus 111 for manufacturing the rack 101 in the above-mentioned procedure, the separating mechanism 141 for separating the rack 101 from the tooth die 114*c* of the upper die 114 provided in the die assembly 113 is disposed outside of the die assembly 113 by paying attention to the fact that the steel pipe 101A formed into the rack is projected from the die assembly 113, whereby the structure of the die assembly 113 is not complicated. Consequently, cost of the die assembly 113 can be reduced and maintenance of the die assembly 113 is facilitated.

Further, when the separating member 142 of the separating mechanism 141 is lowered, the pressing portion 142*b* is brought into a firm contact with the projecting portion 101Ab of the rack 101 from above so as to press down the rack 101 by this pressing portion 142*b*. Thus, reliability of separation of the rack 104 with respect to the tooth die 114*c* is high.

Further, because a reaction force occurring when the rack 104 is separated from the tooth die 114*c* is received by the separating member 142, the reaction force can be prevented from being transmitted to the setting mechanism 151. Consequently, a load accompanied by separation can be prevented from being applied to the setting mechanism 151 each time the separation occurs as compared with a case of separation by lowering the chuck 152, thereby improving the durability of the setting mechanism 151. Because the separating member 142 is a plate-like simple component, not any complicated component for gripping the steel pipe 101A removably, it can be replaced easily at a low cost when it is damaged.

Because the manufacturing apparatus 111 has the setting mechanism 151, insertion of the steel pipe 101A into the die assembly 113 and removal of the rack 101 from the die assembly 113 after the rack is formed can be automated. Under such a condition, this separating member 142 has the through portion 142*a* having a larger diameter than the steel pipe 101A although the separating member 142 is disposed between the chuck 152 and the die assembly 113. Consequently, insertion of the steel pipe 101A into and removal of the rack 101 from the die assembly 113 can be achieved without being disturbed by the separating member 142.

In the meantime, the manufacturing apparatus 111 of this embodiment shares the push rod driving means for pressing the metal core 125 into the steel pipe 101A and reciprocating it by moving the first metal core push rod 131 and the second metal core push rod 135. Thus, no push rod driving means is required for each of the first metal core push rod 131 and the second metal core push rod 135. Because this push rod driving means is disposed on only one side of the die assembly 113, the manufacturing apparatus 111 can be configured simply. Additionally, because the metal core 125 is moved by interlocking the first metal core push rod 131 with the second metal core push rod 135, there is no fear that the operation timing of the first metal core push rod 131 and the second metal core push rod 135 may be messed up.

A fifth embodiment of the present invention will be described with reference to FIG. 28. The fifth embodiment is the same as the fourth embodiment including the configuration not shown in FIG. 28 except the matters described below. The same reference numbers as the fourth embodiment are attached to the same components as the fourth embodiment and description thereof is omitted.

Figure 28:
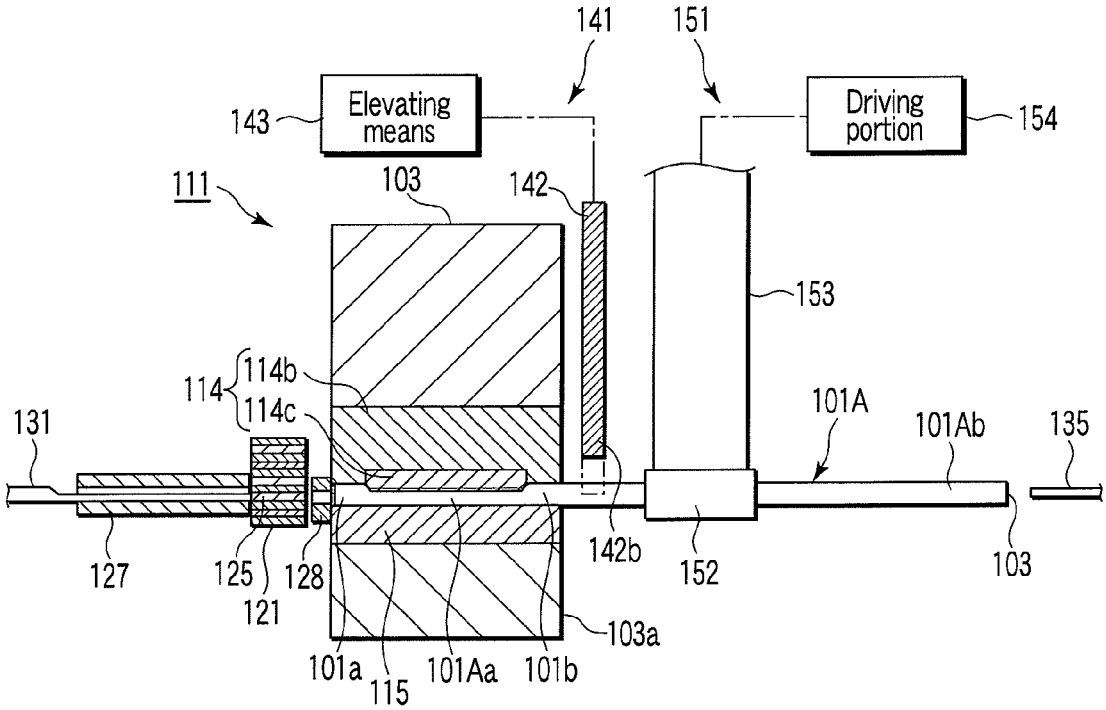
FIG. 28 is a sectional view showing a manufacturing apparatus for carrying out a manufacturing method according to a fifth embodiment of the present invention with the dies clamped.

According to the fifth embodiment, the separating member 142 disposed elevatably outside of the die assembly 113 is provided such that it can be moved by the elevating means 143 between a standby position shown with a solid line in FIG. 28 and a separating position shown with two dots and dash line. The standby position mentioned here refers to a position above the moving trajectory of the steel pipe 101A to be taken into/out of the die assembly 113 by the chuck 152. In this embodiment, the standby position of the separating member 142 is set so that it makes slight contact with the projecting portion 101Ab of the steel pipe 101A raised while attached to the upper die 114 from above when the die assembly 113 is opened or to a higher position in order to eliminate the necessity of raising the separating member 142 interlockingly when the die assembly is opened. The separating position refers to a position in which the separating member 142 intersects the moving trajectory. The fifth embodiment is the same as the fourth embodiment except the maters described above.

To separate the steel pipe 101A attached to the tooth die 114*c* of the upper die 114 from the die assembly, the elevating means 143 of the separating mechanism 141 is operated to lower the separating member 142 with the die assembly 113 opened completely. Consequently, as the separating member 142 is moved from a standby position to a separation position, the pressing portion 142*b* composed of the bottom end portion of the separating member 142 forcibly presses down the projecting portion 101Ab of the steel pipe 101A from above to separate the rack 104 from the tooth die 114*c* with a high reliability. The operation of the fifth embodiment is the same as the fourth embodiment except this point. Therefore, the fifth embodiment can solve the problem of the present invention for the reasons described in the fourth embodiment.

Additionally, the fifth embodiment has the following advantages. Because the separating member 142 does not need to be raised interlockingly with the die assembly opening operation, control on elevating of the separating member 142 is simplified. Because the separating member 142 in the standby position is held at a height in which it does not interfere with the steel pipe 101A which is to be inserted into/removed from the die assembly 113 from sideways, the through portion for avoiding this interference is not required in the separating member 142. Thus, the structure and processing of the separating member 142 are simple.

There is provided a method for manufacturing a hollow rack, the method for manufacturing a hollow rack comprises holding a metallic hollow material having a processing wall portion in which a rack is to be formed with a tooth die at a portion near an end portion in a die assembly having an upper die having a downward directed tooth die and a lower die, such that the tooth die is brought into contact with the processing wall portion while a portion at the other end of the hollow material is projected sideway of the die assembly; plastically fluidizing the fabric of the processing wall portion outward from inside of the hollow material with the metal core pressed into the hollow material so as to form a rack corresponding to the tooth die; and pressing down the portion at the other end of the hollow material projected from the die assembly from above with the die assembly opened so as to separate the hollow material having the formed rack from the upper die and then taking the hollow material out of the die assembly.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for manufacturing a hollow rack comprising:

holding a metallic hollow material having a processing wall portion in which a rack is to be formed by means of a tooth die within a die assembly having the tooth die;

with a first metal core push rod which is inserted into and then removed from the hollow material through an opening at one end of the material and a second metal core push rod which is to be inserted into and then removed from the hollow material through an opening at the other end, sandwiching a metal core disposed on only a side in which the first metal core push rod is inserted into and then removed from the die assembly, preventing rotation of the metal core at least with the first metal core push rod, and with the rotation of the metal core prevented, introducing the metal core into the hollow material from the opening at the one end by both the metal core push rods;

after pressing the metal core into the hollow material with the rotation of the metal core prevented by the first metal core push rod, pushing back the metal core by the second metal core push rod while sandwiching the metal core between the second metal core push rod and the first metal core push rod; and plastically fluidizing a fabric of the processing wall portion adjoining the tooth die outward from inside of the hollow material so as to form a rack corresponding to the tooth die, wherein an end formed into the rotation stop face of the metal core is formed in a convex face or a concave face extending in a thickness direction or width direction of the metal core while a front end formed into the rotation stop face of the first metal core push rod is formed into the concave face or convex face extending in the thickness direction or width direction of the first metal core push rod and wherein both ends is formed into the concave face or convex face extending in width direction of the metal core.

2. The method for manufacturing a hollow rack according to claim 1, wherein the metal core is pressed in by means of the first metal core push rod so that the metal core is stopped in contact with an inside face of an insertion side portion of the second metal core push rod of the processing wall portion in contact with the tooth die, and the pressed-in metal core is pushed back by the second metal core push rod.

3. The method for manufacturing a hollow rack according to claim 1, wherein with the metal core sandwiched by the first metal core push rod and the second metal core push rod kept in contact with both ends of the metal core, the metal core is pressed into the hollow material.

4. A hollow rack manufacturing apparatus comprising:

a die assembly which has a tooth die and holds a metallic hollow material having a processing wall portion in which a rack is to be formed by means of the tooth die;

a plurality of metal cores each having an end formed into a rotation stop face and the other end formed into a flat surface so as to form a rack corresponding to the tooth die by plastically fluidizing the processing wall portion in contact with the tooth die outward from inside of the hollow material when each metal core is pressed into the hollow material successively;

a metal core holder which is disposed on only one side of the die assembly in order to support one of the metal cores with the other end formed into the flat surface directed toward the die assembly so that the metal core is moved to a position which allows the metal core to be inserted into an opening at one end of the hollow material held by the die assembly;

a first metal core push rod which has a front end formed into a rotation stop face, the front end engaging an end formed into the rotation stop face for the metal core, and is inserted into and then removed from the hollow material through an opening at the one end of the metal core holder and the hollow material so that the metal core is pressed into the hollow material while preventing rotation of the metal core by the insertion;

a second metal core push rod which is inserted into and then removed from the hollow material through the opening at the other end from an opposite side to the first metal core push rod, presses the metal core from the metal core holder into the hollow material while the metal core is sandwiched together with the first metal core push rod, and pushes back the metal core toward the metal core holder; and connecting means for connecting the first metal core push rod and the second metal core push rod with the metal core sandwiched by the first metal core push rod and the second metal core push rod, wherein the end formed into the rotation stop face of the metal core is formed in a convex face or a concave face extending in a thickness direction or width direction of the metal core while the front end formed into the rotation stop face of the first metal core push rod is formed into the concave face or convex face extending in the thickness direction or width direction of the first metal core push rod.

5. The hollow rack manufacturing apparatus according to claim 4, wherein a push-in depth of the metal core into the hollow material by the first metal core push rod is defined such that the metal core is stopped in contact with a portion on the side in which the second metal core push rod is inserted, of the processing wall portion in contact with the tooth die.

6. The hollow rack manufacturing apparatus according to claim 4, wherein a metal core guide having a through hole which opposes an opening at the one end of the hollow material and in which the metal core and the first and second metal core push rods sandwiching the metal core are to be inserted is disposed between the metal core and the metal core holder, and the through hole is formed into a shape for preventing rotation of the metal core.

7. A method for manufacturing a hollow rack comprising:

holding a metallic hollow material having a processing wall portion in which a rack is to be formed by means of a tooth die within a die assembly having the tooth die;

with a first metal core push rod which is to be inserted into and then removed from the hollow material through an opening at one end of the material and a second metal core push rod which is to be inserted into and then removed from the hollow material through an opening at the other end, sandwiching a metal core disposed on only a side in which the first metal core push rod is to be inserted into and then removed from the die assembly;

connecting a first connecting member which is moved together with the first metal core push rod and a second connecting member which is moved together with the second metal core push rod so as to maintain a state of sandwiching the metal core by the first and second metal core push rods;

moving the first and second metal core push rods interlockingly in the same direction so as to introduce the metal core into the hollow material through the opening at the one end with this condition, pressing the metal core into the hollow material by means of the first metal core push rod and then pushing back the metal core by means of the second metal core push rod; and plastically fluidizing the fabric of the processing wall portion adjoining the tooth die outward from inside of the hollow material so as to form the rack corresponding to the tooth die.

8. A hollow rack manufacturing apparatus comprising:

a die assembly which has a tooth die and holds a metallic hollow material having a processing wall portion in which a rack is to be formed by means of the tooth die;

a plurality of metal cores for forming a rack corresponding to the tooth die by plastically fluidizing the processing wall portion adjoining the tooth die outward from inside of the hollow material when each metal core is pressed into the hollow material successively;

a metal core holder which is disposed only on one side of the die assembly so as to support the metal core and moves the metal core to a position which allows the metal core to be inserted into the opening at one end of the hollow material held by the die assembly;

a first metal core push rod which is to be inserted into and then removed from the hollow material through the opening at the one end of the metal core holder and the hollow material so as to press the metal core into the hollow material by the insertion;

a second metal core push rod which is to be inserted into and then removed from the hollow material through the opening at the other end from an opposite side to the first metal core push rod and, with the metal core sandwiched together with the first metal core push rod, presses the metal core from the metal core holder into the hollow material while pushing back the metal core toward the metal core holder;

a first connecting member which is moved together with the first metal core push rod;

a second connecting member which is moved together with the second metal core push rod;

connecting means for maintaining a state of the metal core sandwiched by the first and second metal core push rods by connecting the first and second connecting members; and a single driving portion which reciprocates the first and second metal core push rods interlockingly in the same direction so as to press the metal core into the hollow material with the first metal core push rod and push back the metal core with the second metal core push rod with the first and second connecting members connected to each other.

9. The hollow rack manufacturing apparatus according to claim 8, further comprising a driving body for sandwiching the metal core so as to insert/remove the second metal core push rod into/from the hollow material and move the second metal core push rod passed through the hollow material to a position where the metal core is sandwiched together with the first metal core push rod, the driving body being disposed to pull the second metal core push rod toward the die assembly.

10. The hollow rack manufacturing apparatus according to claim 8, wherein a driving source of the driving portion is a servo motor.

11. The hollow rack manufacturing apparatus according to claim 8, further comprising a moving base movable in a direction of the die assembly while supporting the first metal core push rod, wherein the driving portion is disposed on an opposite side to the die assembly with respect to the moving base so as to push and then pull the moving base directly with the driving portion.

12. The hollow rack manufacturing apparatus according to claim 8, wherein the driving portion is disposed so that the driving portion is projected onto the first connecting member as seen in a back-forth direction or up-down direction.

13. A hollow rack manufacturing apparatus comprising:

a die assembly which includes an upper die having a downward directed tooth die and a lower die and holds a metallic hollow material having a processing wall portion in which a rack is to be formed with the tooth die at a portion near an end portion, such that a portion at the other end of the hollow material is projected sideways of the die assembly;

a plurality of metal cores which plastically fluidize the processing wall portion adjoining the tooth die outward from inside of the hollow material when each metal core is pressed into the hollow material so as to form a rack corresponding to the tooth die; and a separating mechanism which is provided outside the die assembly and has a separating member coming into contact with the portion at the other end of the hollow material projecting out of the die assembly from above with the die assembly opened so as to separate the hollow material in which the rack is formed from the upper die.

14. The hollow rack manufacturing apparatus according to claim 13, wherein the separating mechanism includes elevating means for elevating the separating member and separating the hollow material from the upper die by lowering the separating member.

15. The hollow rack manufacturing apparatus according to claim 13, wherein a setting mechanism, which has a movable chuck movable in a direction of a side face of the die assembly and in a vertical direction and inserts/removes a portion having the formed processing wall portion into/from the die assembly from sideways of the die assembly by gripping the hollow material when the die assembly is opened, is provided on an opposite side to the die assembly with respect to the separating member, and a through portion through which the hollow material to be inserted/removed into/from the die assembly passes is provided on the separating member.

16. The hollow rack manufacturing apparatus according to claim 13, wherein a setting mechanism, which has a chuck movable in a direction of a side face of the die assembly and in a vertical direction and inserts/removes a portion having the formed processing wall portion into/from the die assembly from sideways of the die assembly by gripping the hollow material when the die assembly is opened, is provided on an opposite side to the die assembly with respect to the separating member, and the separating mechanism includes elevating means for elevating/lowering the separating member between a standby position above the hollow member to be inserted/removed into/from the die assembly and a separating position for pressing down portion at the other end.

* * * * *